US005594530A

United States Patent [19]

Masuda et al.

[11] Patent Number: 5,594,530

[45] Date of Patent: Jan. 14, 1997

[54] SERIAL PRINTER HAVING CARRIAGE WITH INDEPENDENTLY MOVABLE IMAGE BEARING MEMBER AND FIXING UNIT

[75] Inventors: Syuzo Masuda; Ryouichi Iwama, both of Kawasaki, Japan

[73] Assignee: Fujitsu Limited, Kawasaki, Japan

[21] Appl. No.: 429,135

[22] Filed: Apr. 26, 1995

[30] Foreign Application Priority Data

May 18, 1994 [JP] Japan ..... 6-104085

[51] Int. Cl.[6] ..... G03G 15/04; G03G 15/22

[52] U.S. Cl. ..... 399/111; 347/156; 399/130

[58] Field of Search ..... 355/200, 210, 355/211, 282, 285; 347/138, 152, 129, 156

[56] References Cited

U.S. PATENT DOCUMENTS 4,639,749 1/1987 Ito ..... 347/152
4,845,519 7/1989 Fuse ..... 347/129
5,467,177 11/1995 Iwama et al. ..... 355/282

FOREIGN PATENT DOCUMENTS 56-077167 5/1981 Japan .
61-152463 7/1986 Japan .
61-145649 U 9/1986 Japan .

*Primary Examiner*—Joan H. Pendegrass
*Attorney, Agent, or Firm*— Staas & Halsey

[57] ABSTRACT

A serial printer has a transport mechanism for transporting a recording sheet in a sheet transport direction, a process part including an image bearing member with a rotary shaft which extends in a direction parallel to the sheet transport direction for forming a latent image on the image bearing member by charging the image bearing member and developing the latent image into a developed image, a fixing unit for fixing the developed image on the image bearing member onto the recording sheet, and a carriage movable in a carriage moving direction perpendicular to the sheet transport direction and supporting the process part and the fixing unit. The process part and the fixing unit are independently movable on the carriage.

24 Claims, 21 Drawing Sheets

51D

SERIAL PRINTER HAVING CARRIAGE WITH INDEPENDENTLY MOVABLE IMAGE BEARING MEMBER AND FIXING UNIT

BACKGROUND OF THE INVENTION

The present invention generally relates to serial printers, and more particularly to a serial printer which prints an image on a recording sheet using the electrophotography technique by forming a toner image on the recording sheet by a recording drum.

Recently, in order to meet the demands to reduce both the cost and size of printers using the electrophotography technique, serial printers provided with a carriage that carries out the printing using the electrophotography technique have been developed. According to such a serial printer, the carriage is moved on a transfer unit in a direction perpendicular to a transport direction of the recording sheet so as to transfer an image on the recording sheet, and the transferred image on the recording sheet is fixed by a fixing unit which has the form of a roller arranged in the transport direction. There are now demands to improve the printing quality of such serial printers.

FIGS. 1A and 1B show the construction of a first conventional serial printer. FIG. 1A shows a plan view of a part of this first conventional serial printer, and FIG. 1B shows a cross section of a carriage of this first conventional serial printer.

A serial printer 11 shown in FIGS. 1A and 1B is proposed in a Japanese Laid-Open Patent Application No. 61-152463, for example. A shaft 14 is arranged parallel to transport rollers 13*a* and 13*b* which transport a recording sheet 12 in a transport direction shown by arrow T in FIG. 1A. A carriage 15 is movable in a direction perpendicular to the transport direction under guidance of the shaft 14, and this carriage 15 is driven by a driving motor (not shown). A fixing unit 16 having a width greater than the width of the recording sheet 12 is fixedly arranged on the downstream side of transport roller 13*a* in the transport direction. A transfer unit 17 is arranged under the recording sheet 12 along a moving direction of the carriage 15.

An image bearing member 21 is provided in the carriage 15, and this image bearing member 21 rotates at a peripheral speed in synchronism with the movement of the carriage 15. The surface of the image bearing member 21 is uniformly charged by a charger 22, and an electrostatic latent image is formed on the surface of the image bearing member 21 by an exposing unit 23. The electrostatic latent image on the surface of the image bearing member 21 is visualized into a toner image by a developing roller 26 using a toner 25 of a developing unit 24. The toner image on the image bearing member 21 is transferred onto the recording sheet 12 by the transfer unit 17 which confronts the image bearing member 21 via the recording sheet 12, and the transferred image is fixed when it is transported to the position of the fixing unit 16.

FIG. 2 shows the construction of a carriage provided with a fixing unit. This carriage is proposed in a Japanese Laid-Open Utility Model Application No. 61-145849, for example. A fixing unit 27 is provided inside a carriage 15. A cleaner 30 cleans the surface of the image bearing member 21 after the printing ends so as to remove the residual toner.

A fixing roller 28 which rotates in the same direction as the image bearing member 21 is provided in the fixing unit 27. A heat source 29 such as a halogen lamp is provided within the fixing roller 28 as a heating means. This fixing roller 28 is preheated to a predetermined temperature by the heat source 29 prior to the printing operation, and the temperature during the printing is controlled by detecting the temperature by a temperature detector (not shown) such as a thermistor. In other words, the fixing unit 27 is moved together with the image bearing member 21 and carries out the image fixing immediately after the image transfer.

The image transfer by the transfer unit 17 is carried out by applying a predetermined voltage across the transfer unit 17 and the image bearing member 21. Hence, a conductive member such as conductive rubber is formed on a substrate which forms the transfer unit 17.

FIGS. 3, 4A and 4B show a second conventional serial printer. FIG. 3 shows a plan view of this second conventional serial printer. FIG. 4A shows a cross section along a line 4A—4A in FIG. 3, and FIG. 4B shows a cross section along a line 4B—4B in FIG. 3. A carriage 34 of a serial printer 31 is provided with a processing part 32 and a fixing unit 33. This carriage 34 is guided by guide shafts 35*a* and 35*b*, and is moved in a direction shown by arrow P in FIG. 4A, perpendicular to the transport direction, shown by arrow T in FIG. 3, of a recording sheet by a carrier motor 36 via a belt 37.

A transfer unit (transfer platen) 39 is arranged under the carriage 34 along the moving direction of the carriage 34. A transport roller 40 is provided on the upstream side of the transfer unit 39 along the transport direction T, and transports the recording sheet 38 in the transport direction indicated by the arrow T in FIGS. 3 and 4B.

In FIG. 4A, the processing part 32 of the carriage 34 is provided with a recording drum 21, similarly to the case shown in FIG. 2. The recording drum 21 rotates on the recording sheet 38 which is on the transfer unit 39 in synchronism with the movement of the carriage 34 through a rack-and-pinion mechanism.

The surface of the recording drum 21 is uniformly charged by the charger 22, and an electrostatic latent image is formed on this surface by the exposing unit 23. The electrostatic latent image is visualized as a toner image by the developing roller 26 using the toner 25 within the developing unit 24. The toner image formed on the surface of the recording drum 21 is transferred onto the recording sheet 38 by applying a predetermined voltage across the recording drum 21 and the transfer unit 39 which confronts the recording drum 21 via the recording sheet 38. After the image transfer, the surface of the recording drum 21 is discharged, and the residual toner after the discharge is removed by the cleaner 30. The fixing unit 33 is provided with the fixing roller 28, and the temperature of the fixing roller 28 is controlled to a predetermined temperature by a thermistor 28*a*.

In FIG. 4A, the recording sheet 38 is transported between the recording drum 21 and the transfer unit 39 by the transport roller 40.

Although not shown, a fixing unit is provided within the carriage, and this fixing unit is provided with a non-contact type heat source that irradiates a heat ray on the recording sheet. The non-contact type heat source may be a halogen lamp using infrared ray or, a xenon lamp using flash fixing. According to the serial printer proposed in a Japanese Laid-Open Patent Application No. 56-77167, for example, the image bearing member (recording drum) recedes from the recording sheet about a guide shaft of the carriage when transporting the recording sheet.

Next, a description will be given of a third conventional serial printer, by referring to FIGS. 5A through 5C. FIG. 5A shows a plan view of the third conventional serial printer. FIG. 5B shows a cross section along a line 5B—5B in FIG. 5A, and FIG. 5C shows a cross section along a line 5C—5C in FIG. 5A.

In a serial printer $31_A$ shown in FIGS. 5A through 5C, the recording drum 21 and a fixing roller 28*a* are respectively rotated by motors 41 and 42 via belts 41*a* and 42*a* at peripheral speeds synchronized to the movement of the carriage 34. Otherwise, the serial printer $31_A$ is basically the same as that shown in FIGS. 3, 4A and 4B.

FIG. 6A and 6B are diagrams for explaining the printing operation of the serial printer $31_A$. As shown in FIGS. 6A and 6B, the recording sheet 38 is pinched between the transfer unit 39 and the recording drum 21 and the fixing roller 28*a*, and the recording drum 21 and the fixing roller 28*a* rotate so as to travel along sheet 38 in direction perpendicular to the transport direction T of the recording sheet 38, thereby to carry out the printing and fixing of a single line. The recording drum 21 and the fixing roller 28*a* return to an original position (home position) after the printing and fixing of the single line. Then, the recording sheet 38 is transported by a predetermined amount, and the printing and fixing are repeated thereafter in a similar manner for the subsequent lines.

In this case, as shown in FIG. 6B, a fixed area $38_{b1}$, indicated by vertical dashed lines, is larger than a first printed area $38_{a1}$, indicated by cross-hatching. When a second printed area $38_{a2}$ indicated by cross-hatching, is formed in continuous relationship with the first printed area $38_{a1}$, a fixed area $38_{b2}$ indicated by horizontal dashed lines is formed, and this fixed area $38_{b2}$ is larger than the second printed area $38_{a2}$. Such a process of forming the printed area and the fixed area is repeated in a similar manner.

However, according to the first conventional serial printer shown in FIGS. 1A and 1B, the fixing unit 16 is provided outside the carriage 15. For this reason, there are problems in that the size of the serial printer becomes large, and the serial printer becomes expensive because the fixing roller must have a length at least amounting to the width of the line to be printed on the recording sheet 12. In addition, because the length of the fixing roller amounts to the width of the recording sheet 12, even though the recording sheet 12 is transported intermittently, the contact time between the fixing roller and the recording sheet 12 having the toner image transferred thereon becomes greatly different between the part where the recording sheet 12 is stationary and the part where the recording sheet 12 is transported. This difference in the contact time introduces inconsistent fixing, presenting a problem in that the image quality of the printed image on the recording sheet 12 becomes poor.

On the other hand, according to the carriage shown in FIG. 2, the recording drum 21 and the fixing roller 28 constantly make contact with the recording sheet 12 or the transfer unit 17. For this reason, there is a problem in that the residual toner on the recording drum 21 may be transferred to parts other than the recording sheet 12, causing contamination. In addition, the toner 25 or the like on the transfer unit 17 may adhere on the fixing roller 28 and become fixed on the recording sheet 12, and in such a case, there is a problem in that the image quality of the image printed on the recording sheet 12 becomes poor.

Furthermore, according to the serial printer proposed in the Japanese Laid-Open Patent Application No. 56-77167, it is difficult to apply a sufficient amount of heat on the recording sheet when carrying out the fixing by the fixing unit using the non-contact type heat source. As a result, there is a problem in that a satisfactory fixing cannot be guaranteed. In this case, the halogen lamp, which heats the toner by infrared ray, requires an extremely long time for the fixing due to the low energy density, and in addition, there is a danger in that a fire may occur if a jam of the recording sheet is generated. On the other hand, according to the flash fixing using the xenon lamp, there are problems in that a large condenser becomes necessary, the toner is scattered, unpleasant noise is generated, and continuous irradiation is difficult in the case of the serial printer. Moreover, in either case where the halogen lamp or the xenon lamp is used, the lamp is be arranged close to the recording drum on the carriage, and there is a problem in that it is difficult to block the ray from the lamp with respect to the recording drum.

According to the second conventional serial printer shown in FIGS. 3, 4A and 4B, the carriage 34 provided with the process part 32 and the fixing unit 33 is guided by the guide shafts 35*a* and 35*b*. For this reason, there are problems in that it is difficult to independently attend to the maintenance of the processing part 32 and the fixing unit or to replace the consumption parts of the serial printer 31 such as the recording drum 21. In addition, since the fixing roller 28 is heated to a high temperature, there are problems in that the service life of the fixing roller 28 is short, and the high temperature gives undesirable effects on the processing part 32 causing deterioration of the image quality. Furthermore, the respective distances between the recording sheet 38 and the recording drum 21 and the fixing roller 28 do not become constant because of the unevenness of the guide shafts 35*a* and 35*b*, the warping of the fixing roller 28 due to the heating and pressure, and the warping of the transfer unit along the carriage moving direction, and there was a problem in that satisfactory fixing cannot be made due to poor transfer and insufficient pressure.

On the other hand, according to the serial printer $31_A$ shown in FIGS. 5A through 5C, the fixing width is greater than the printing width, and a non-printed region on the recording sheet 38 is also heated by the fixing unit 33. As a result, both heated parts and non-heated parts are generated within the non-printing region on the recording sheet 38, and the moisture absorbency of the recording sheet 38 changes due to the heating. The change in the moisture absorbency of the recording sheet 38 causes the resistance of the recording sheet 38 to become non-uniform, and there was a problem in that the image quality becomes poor due to the non-uniform resistance of the recording sheet 38. In addition, since the fixing roller 28*a* is rotated by the motor 42, there were problems in that the carriage 34 becomes large and heavy, thereby increasing both the size and cost of the serial printer $31_A$.

SUMMARY OF THE INVENTION

Accordingly, it is a general object of the present invention to provide a novel and useful serial printer in which the problems described above are eliminated.

Another and more specific object of the present invention is to provide a serial printer comprising transport means for transporting a recording sheet in a sheet transport direction, process means, including an image bearing member with a rotary shaft which extends in a direction parallel to the sheet transport direction, for forming a latent image on the image bearing member by charging the image bearing member and developing the latent image into a developed image, fixing means for fixing the developed image on the image bearing member onto the recording sheet, and a carriage movable in a carriage moving direction perpendicular to the sheet transport direction and supporting the processing means and the fixing means, the processing means and the fixing means being independently movable on the carriage. According to the serial printer of the present invention, the processing means and the fixing means can move independently of each other depending on the surface state of the recording sheet, that is, the transfer means that carries out the transfer of the toner image. As a result, it is possible to stably transfer and fix the image on the recording sheet and accordingly improve the printing quality. It is also possible to apply a constant pressure on the image bearing member and the fixing means during the printing, so that the printing quality is improved.

Still another object of the present invention is to provide a serial printer comprising transport means for transporting a recording sheet in a sheet transport direction, processing means, including an image bearing member with a rotary shaft which extends in a direction parallel to the sheet transport direction, for forming a latent image on the image bearing member by charging the image bearing member and developing the latent image into a developed image, fixing means, including a fixing member, for fixing the developed image on the image bearing member onto the recording sheet by the fixing member, and a carriage movable in a carriage moving direction perpendicular to the sheet transport direction and supporting the processing means and the fixing means, where the image bearing member and the fixing member are arranged at positions on the carriage deviated in the sheet transport direction. According to the serial printer of the present invention, it is possible to prevent an overlap of the fixing within the same printed region on the recording sheet, and thus, the printing quality can be improved.

A further object of the present invention is to provide a serial printer comprising transport means for transporting a recording sheet in a sheet transport direction, processing means, including an image bearing member with a rotary shaft which extends in a direction parallel to the sheet transport direction, for forming a latent image on the image bearing member by charging the image bearing member and developing the latent image into a developed image, fixing means, including a fixing roller, for fixing the developed image on the image bearing member onto the recording sheet by the fixing roller, and a carriage movable in a carriage moving direction perpendicular to the sheet transport direction and supporting the processing means and the fixing means, where the fixing roller has flanges on both ends thereof along the sheet transport direction, the flanges having a diameter smaller than a diameter of a remaining portion of the fixing roller. According to the serial printer of the present invention, the flanges of the fixing roller will not make contact with the printed region on the recording sheet, and the printing quality can thus be improved.

Another object of the present invention is to provide a serial printer comprising transport means for transporting a recording sheet in a sheet transport direction, processing means, including an image bearing member with a rotary shaft which extends in a direction parallel to the sheet transport direction, for forming a latent image on the image bearing member by charging the image bearing member and developing the latent image into a developed image, fixing means, including a fixing member, for fixing the developed image on the image bearing member onto the recording sheet by the fixing member, a carriage movable in a carriage moving direction perpendicular to the sheet transport direction and supporting the process means and the fixing means, and transfer means, including a transfer member, for transferring the developed image on the image bearing member onto the recording sheet that is interposed between the image bearing member and the transfer member, where the transfer member has a width smaller than a width of fixing member when the widths are taken along the sheet transport direction. According to the serial printer of the present invention, it is possible to prevent a pressed mark from being formed on the recording sheet at the ends of the fixing member, and the printing quality can be improved thereby.

Still another object of the present invention is to provide a serial printer comprising transport means for transporting a recording sheet in a sheet transport direction, processing means, including an image bearing member with a rotary shaft which extends in a direction parallel to the sheet transport direction, for forming a latent image on the image bearing member by charging the image bearing member and developing the latent image into a developed image, fixing means for fixing the developed image on the image bearing member onto the recording sheet, a carriage movable in a carriage moving direction perpendicular to the sheet transport direction and supporting the process means and the fixing means, the processing means and the fixing means being independently movable on the carriage, and transfer means, including a transfer member, for transferring the developed image on the image bearing member onto the recording sheet that is interposed between the image bearing member and the transfer member, where the transfer member has a conductive plate, and a resilient heat-resistant conductive member provided on the conductive plate. According to the serial printer of the present invention, it is possible to prevent undesirable effects of heat generated from the fixing means, and accordingly, the printing quality can be improved.

Other objects and further features of the present invention will be apparent from the following detailed description when read in conjunction with the accompanying drawings.

DESCRIPTION OF THE PREFERRED EMBODIMENTS

Figure 7:
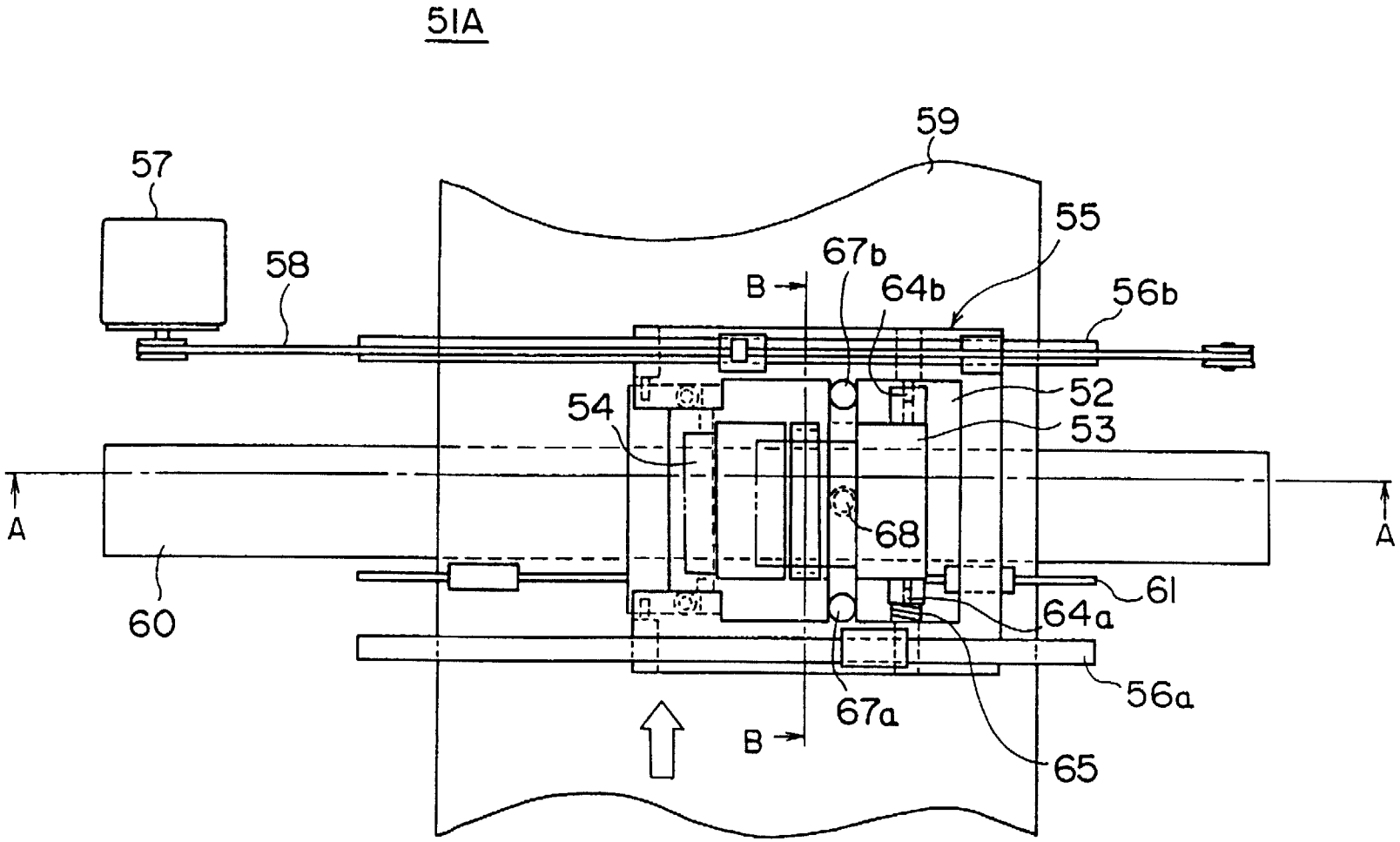
FIG. 7 is a plan view showing a part of a first embodiment of a serial printer according to the present invention.

FIG. 7 is a plan view showing the construction of a first embodiment of a serial printer according to the present invention. A serial printer $\mathbf{51}_A$ shown in FIG. 7 has a carriage 55 with a slide member 52, and a process part 53 and a fixing unit 54 are mounted on the slide member 52. The carriage 55 is movable in a state where the slide member 52 is guided by guide shafts 56*a* and 56*b*. A carrier motor 57 drives the carriage 55 via a belt 58, so that the carriage 55 moves in a direction perpendicular to a transport direction of a recording sheet 59.

A transfer unit (transfer platen) 60 is arranged along the moving direction of the carriage 55 under the carriage 55 and between the guide shafts 56*a* and 56*b*. A transport roller 61 is provided along the carriage moving direction P, on the upstream side along the sheet transport direction, and this transport roller 61 transports the recording sheet 59 in the direction of an arrow T in FIG. 7. As will be described later in more detail in conjunction with a sixth embodiment, the transfer unit 60 is made up of a substrate made of aluminum or the like, and a heat-resistant conductive member provided on the substrate on the side of the carriage 55. For example, the heat-resistant conductive member is made of silicon rubber mixed with a conductive material.

Figure 8A:
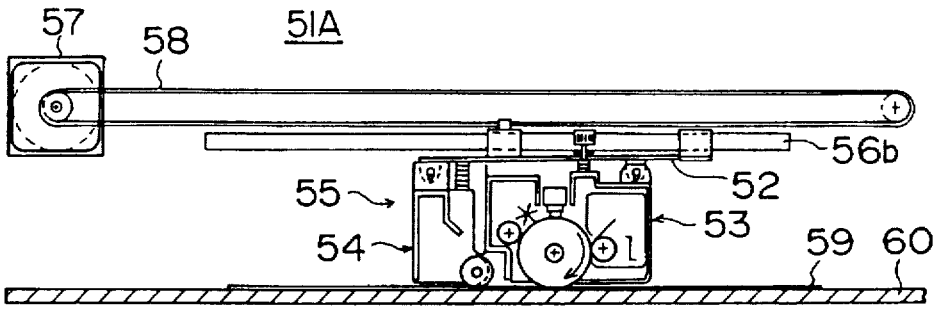
FIG. 8A is a cross sectional view along a line 8A—8A in FIG. 7.
Figure 8B:
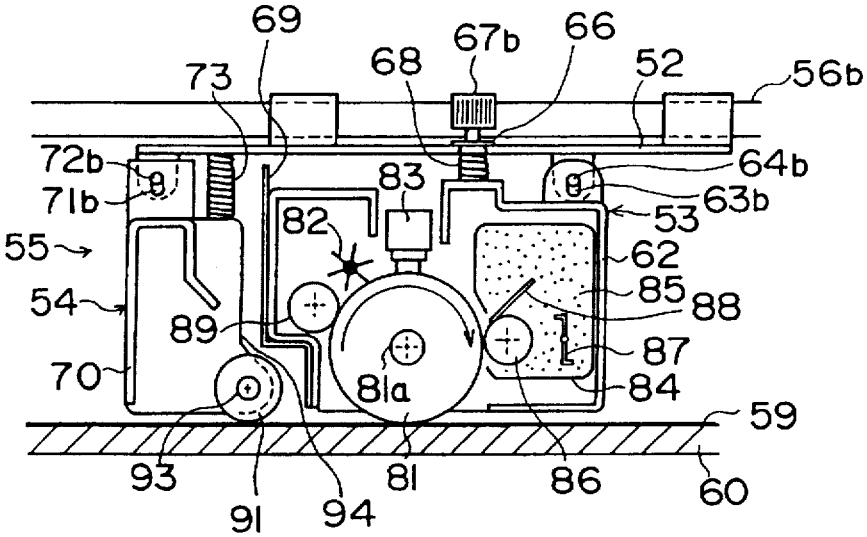
FIG. 8B is a cross sectional view showing a carriage of the first embodiment on an enlarged scale.

FIG. 8A shows a cross section along a line A—A in FIG. 7, and FIG. 8B shows an enlarged view of the carriage 55.

Figure 9:
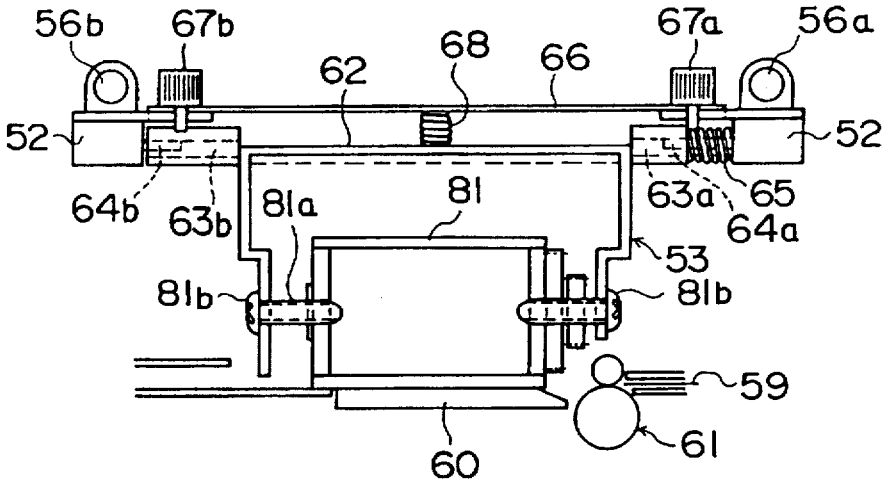
FIG. 9 is a cross sectional view along a line 9B—9B in FIG. 7.

In FIGS. 8A and 8B, pins 64*a* and 64*b* of the slide member 52 slidably engage elongated holes 63*a* and 63*b* formed in an end part of a top plate of a processing part housing 62, so that the process part 53 is arranged on the downstream side of the slide member 52 along the carriage moving direction. A first link means is formed by the elongated holes 63*a* and 63*b* and the pins 64*a* and 64*b*. As shown in FIGS. 7 and 9, a spring 65 is provided with respect to the pin 64*a* between the slide member 52 and the process part housing 62.

A holding plate 66 is provided across the slide member 52, and the slide member 52 and the process part housing 62 are fixed at both ends of the holding plate 66 by thumb screws 67*a* and 67*b*. A spring 68 is interposed between the holding plate 66 and a central part of the top plate of the process part housing 62.

The spring 65 is provided to absorb the play in the sheet transport direction when the process part 53 is mounted. On the other hand, the spring 68 is provided to push a recording drum, which will be described later, against the recording sheet 59 and to absorb the undulations of the transfer unit 60.

For example, the process part housing 62 is made of a heat insulating material such as a resin having a low thermal conductivity. A heat radiation member 69 made of aluminum or the like is mounted on the side of the processing part housing 62 facing the fixing unit 54 as shown in FIG. 8B.

On the other hand, pins 72*a* and 72*b* of the slide member 52 slidably engage elongated holes 71 and 71*b* formed in a top plate of a fixing unit housing 70, so that the fixing unit 54 is arranged on the slide member 52 on the home position side relative to the carriage moving direction. A spring 73 is provided between the slide member 52 and the fixing unit 54. A second link means is formed by the elongated holes 71*a* and 71*b* and the pins 72*a* and 72*b*. The spring 73 pushes a fixing roller which will be described later against the recording sheet 59, and also absorbs the undulations of the transfer unit 60.

The process part 53 has a recording drum 81 which rotates about a rotary shaft 81*a* which is parallel to the sheet transport direction. The recording drum 81 rotates on the recording sheet 59 placed on the transfer unit 60 at a peripheral speed synchronized to the movement of the carriage 55. As shown in FIG. 9 which shows a cross section along a line B—B in FIG. 7, the rotary shaft 81*a* is detachably mounted on the process part housing 62 by screws 81*b*.

The recording drum 81 has a photosensitive surface made of amorphous silicon, organic photosensitive material or the like. The surface of the recording drum 81 is uniformly charged by a charger 82, and an electrostatic latent image is formed on the charged surface by an exposure unit 83. The exposure unit 83 is made up of a LED head including a LED array for making the exposure and a SELFOC lens. The electrostatic latent image is visualized into a toner image by a toner 85 within a developing unit 84 and a developing roller 86. An agitator 87 agitates the toner 85 within the developing unit 84, and a blade 88 adjusts the amount of toner 85 supplied to the surface of the recording drum 81.

The toner image on the recording drum 81 is transferred onto the recording sheet 59 by applying a predetermined voltage across the recording drum 81 and the transfer unit 60 which confronts the recording drum 81 via the recording sheet 59. The recording drum 81 rotates in synchronism with the movement of the carriage 55.

After the toner image is transferred onto the recording sheet 59, the surface of the recording drum 81 is discharged, and the residual toner on the recording drum 81 after the discharge is removed by a cleaner 89.

The fixing unit 54 is provided with a fixing roller 91, and the fixing roller 91 is heated by a halogen lamp 93 which is provided within the fixing roller 91. A thermistor 94 is also provided in the fixing unit 54 to detect and control the temperature of the fixing roller 91. For example, the fixing roller 91 has a metal surface that is subjected to a surface processing such as a teflon coating.

In FIG. 9, the processing part 53 is mounted via the spring 65 which urges the processing part 53 in the sheet transport direction, so as to absorb the mounting play. In addition, the spring 68 pushes the processing part 53 towards the transfer unit 60 and absorbs the undulations of the transfer unit 60. In this case, it is possible to apply a constant pressure on the processing part 53 by the sliding engagement of the pins **64*a* and 64*b* with respect to the elongated holes 63*a* and 63*b*. The transport roller 61 transports the recording sheet 59 between the recording drum 81 and the transfer unit 60**.

Figure 10A:
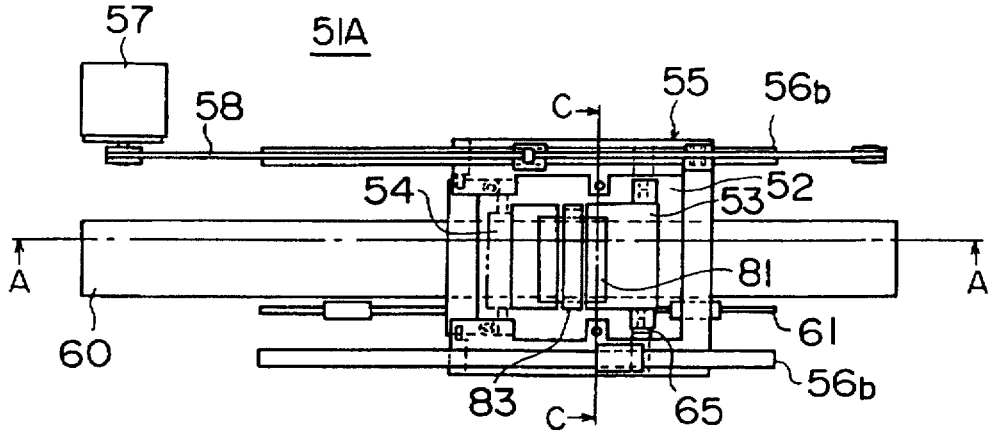
FIG. 10A is a plan view for explaining the replacement and maintenance of a process part of the first embodiment.
Figure 10B:
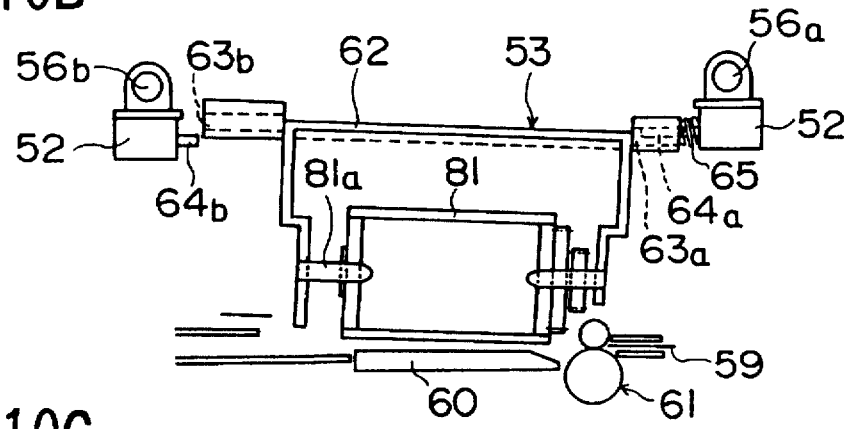
FIGS. 10B and 10C respectively are cross sectional views along lines 10B—10B and 10C—10C, respectively, in FIG. 10A.

Next, a description will be given of the replacement and maintenance of the processing part 53 of the first embodiment, by referring to FIGS. 10A through 10C. FIG. 10A shows a plan view of the first embodiment, FIG. 10B shows a cross section along a line 10B—10B in FIG. 10A, and FIG. 10C shows a cross section along a line 10C—10C in FIG. 10A.

First, the holding plate 66 shown in FIG. 10A is removed by turning the thumb screws **67*a* and 67*b*. Then, in FIG. 10B, when replacing the processing part 53, the processing part 53 is pushed in a direction so as to squeeze the spring 65 so that the pin 64*b* escapes from the elongated hole 63*b*. Thereafter, the pin 64*a* is disengaged from the elongated hole 63*a*, so as to remove the process part 53**.

For example, when replacing the recording drum 81, it is possible to remove the recording drum 81 by simply removing the screws **81*b***.

Figure 10C:
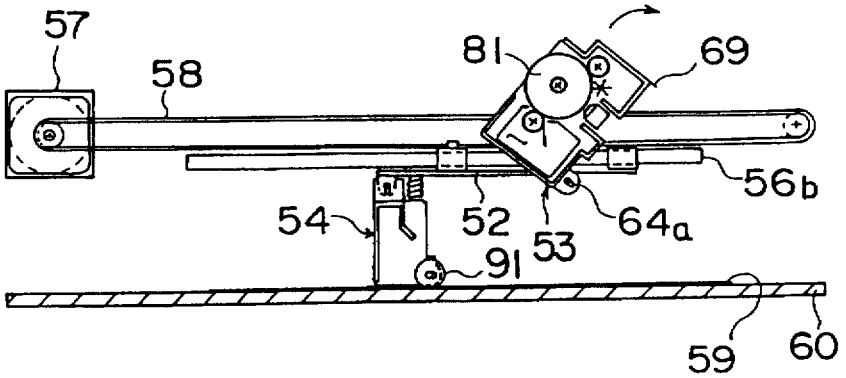

On the other hand, when attending to the maintenance of the recording drum 81, the recording drum 81 is turned about the pins **64*a* and 64*b* as indicated by an arrow in FIG. 10C, so that the exposed surface of the recording drum 81** faces up. The replacement of parts and the maintenance of the parts such as cleaning can be made in this state.

Accordingly, it is possible to easily turn or remove the processing part 53. This ease enables the replacement and maintenance of the parts to be made frequently with a high reliability. As a result, it is possible to improve the printing quality and also extend the life of the consumption parts.

Figure 11A:
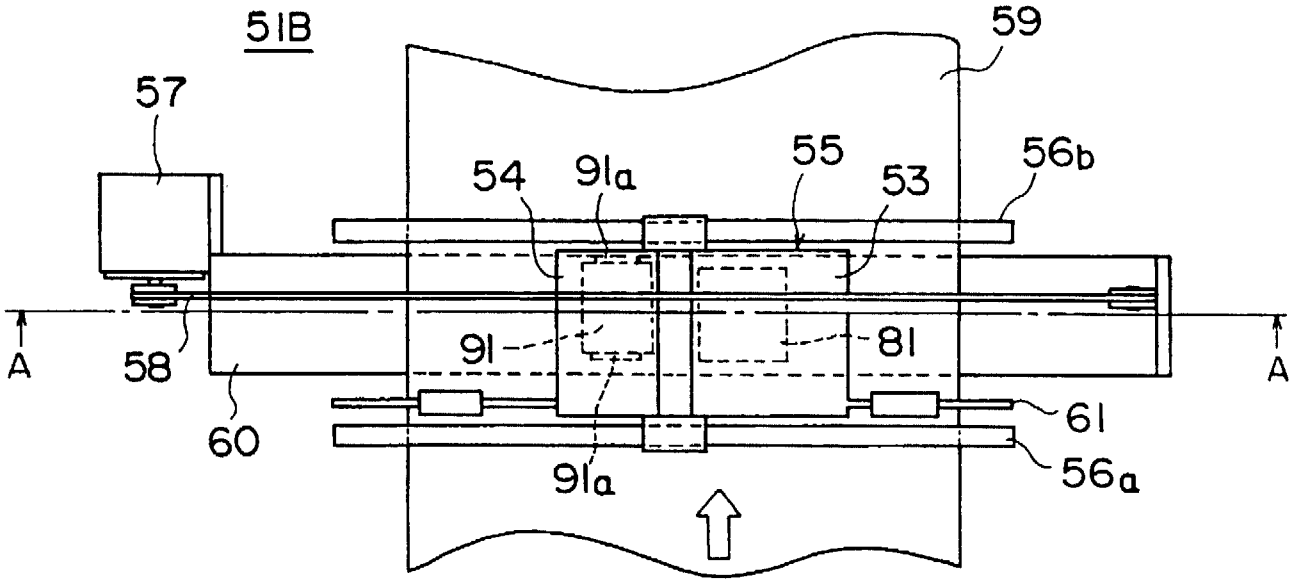
FIG. 11A is a plan view showing a part of a second embodiment of the serial printer according to the present invention.
Figure 11B:
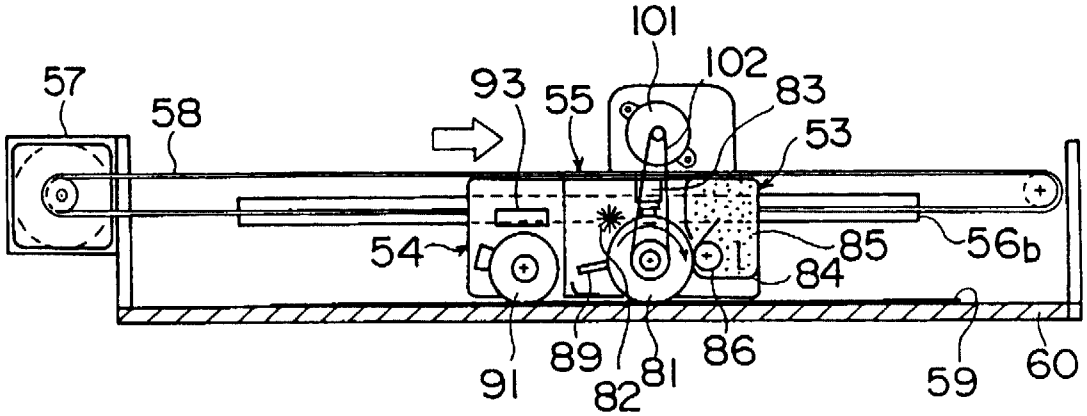
FIG. 11B is a cross sectional view along a line 11B—11B in FIG. 11A.

Next, a description will be given of a second embodiment of the serial printer according to the present invention. FIG. 11A shows a plan view of the second embodiment, and FIG. 11B shows a cross section along a line 11B—11B in FIG. 11A. In FIGS. 11A and 11B, those parts which are the same as those shown in FIGS. 7 through 10C are designated by the same reference numerals, and a description thereof will be omitted.

In a serial printer $\mathbf{51}_B$ shown in FIGS. 11A and 11B, the carriage 55 which is provided with the processing part 53 and the fixing unit 54 is moved in a direction P perpendicular to the sheet transport direction T by the carrier motor 57 via the belt 58, under the guidance of the guide shafts **56*a* and 56*b*. In addition, the transfer unit 60 is arranged under the carriage 55** and extends in the carriage moving direction.

The transport roller 61 transports the recording sheet 59 between the carriage 55 and the transfer unit 60.

As described above, the process part 53 has the charger 82, the exposing unit 83, the developing unit 84 and the cleaner 89 arranged around the recording drum 81. In addition, a driving motor 101 for rotating the recording drum 81 is provided in the process part 53, and the rotational force of the driving motor 101 is transmitted to the recording drum 81 via a belt 102.

On the other hand, the fixing unit 54 is provided with the fixing roller 91 and the halogen lamp 93. Flanges **91*a* for rotatably mounting the fixing roller 91 are provided on respective ends of the fixing roller 91. One flange 91*a* is provided on the upstream side and the other flange 91*a* is provided on the downstream side relative to the sheet transport direction. The diameters of the flanges 91*a* are smaller than the diameter of the fixing roller 91. The fixing roller 91 rotates as the carriage 55 moves due to the friction between the fixing roller 91 and the recording sheet 59 that is introduced when the fixing roller 91 makes contact with the recording sheet 59**.

In this case, the fixing roller 91 is arranged at a position deviated from the position of the recording drum 81 towards the downstream side along the sheet transport direction. Hence, a printed region formed by the recording drum 81 and a fixed region formed by the fixing roller 91 are different.

Figure 12A:
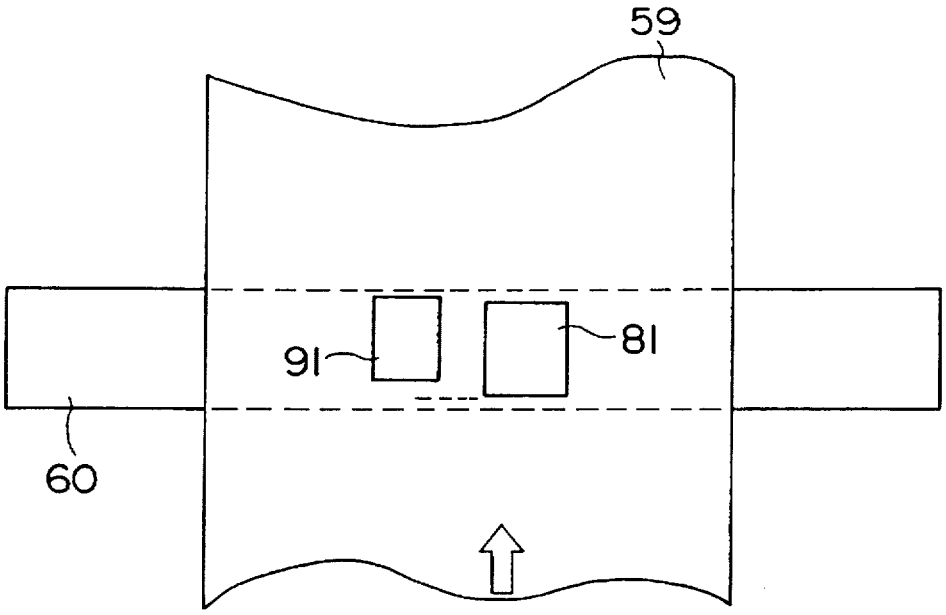
FIGS. 12A and 12B respectively are diagrams for explaining the print operation of the second embodiment.
Figure 12B:
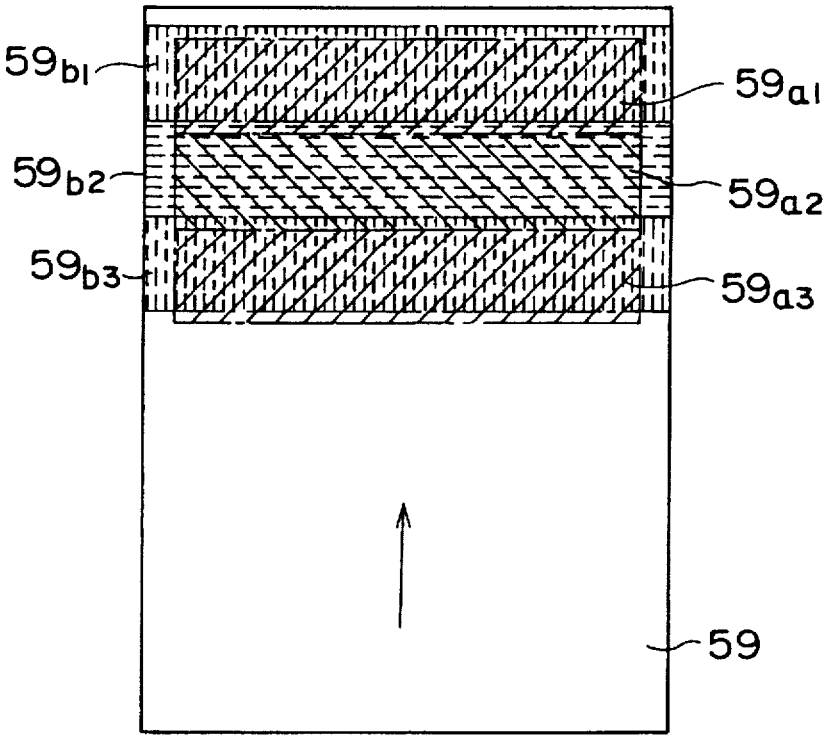

Next, a description will be given of the print operation of the second embodiment, by referring to FIGS. 12A and 12B. As shown in FIGS. 12A and 12B, the recording drum 81 and the fixing roller 91 rotate so as to travel in a direction perpendicular to the transport direction T of the recording sheet 59 that is pinched between the transfer unit 60 and the recording drum 81 and the fixing roller 91, thereby to print and fix a single line before the carriage 55 returns to the home position. Then, the recording sheet 59 is transported by a predetermined amount, and the printing and fixing are repeated in a similar manner.

In this case, as shown in FIG. 12B, a first fixed area $\mathbf{59}_{b1}$, indicated by vertical dashed line, is deviated from a first printed area $\mathbf{59}_{a1}$, indicated by cross-hatching, in the sheet transport direction. A second printed area $\mathbf{59}_{a2}$ indicated by the hatching is formed in continuous relationship with the first printed area $\mathbf{59}_{a1}$, and a second fixed area $\mathbf{59}_{b2}$, indicated by the horizontal dashed lines, is formed in continuous relationship with the first fixed area $\mathbf{59}_{b1}$. In this state, since the diameters of the flanges **91*a* are smaller than the diameter of the fixing roller 91, it is possible to prevent the flanges 91*a*** from making contact with the non-fixed printed area.

In other words, the rear end part of each of the printed areas $\mathbf{59}_{a1}, \ldots$ along the sheet transport direction is fixed by the corresponding one of the next fixed areas $\mathbf{59}_{b2}, \ldots$.

In addition, the last line on the recording sheet 59 can be fixed by carrying out the fixing after making a blank printing of the last line, for example, so as to prevent the generation of a non-fixed part.

Figure 1A:
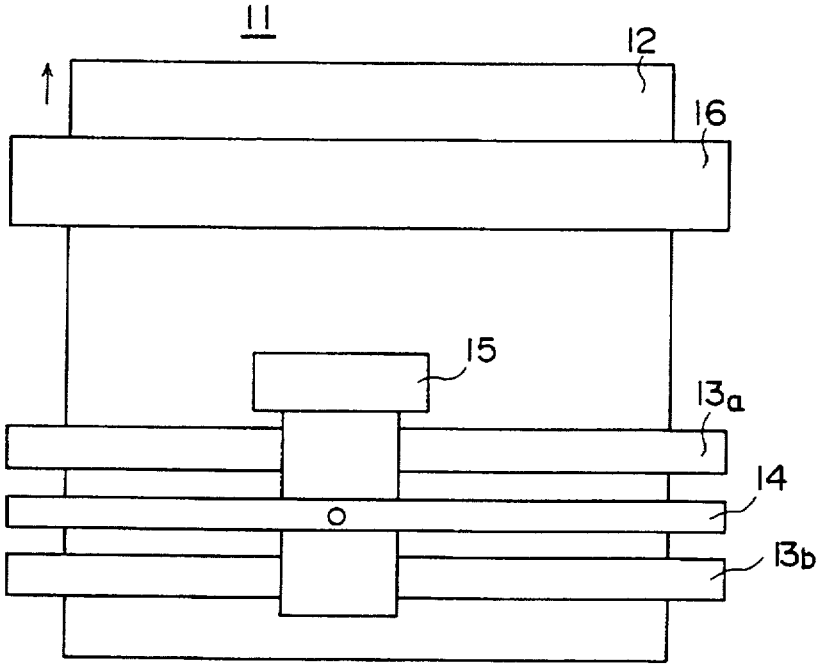
FIG. 1A PRIOR ART
FIGS. 1A and 1B respectively are a plan view and a cross sectional view showing a part of a first conventional serial printer.
Figure 1B:
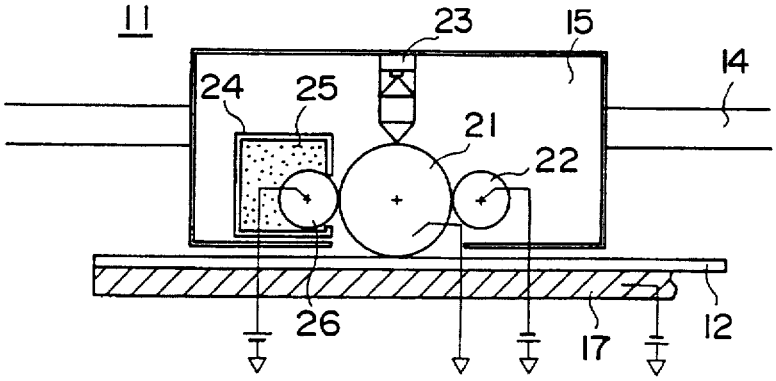
FIG. 1B PRIOR ART
Figure 2:
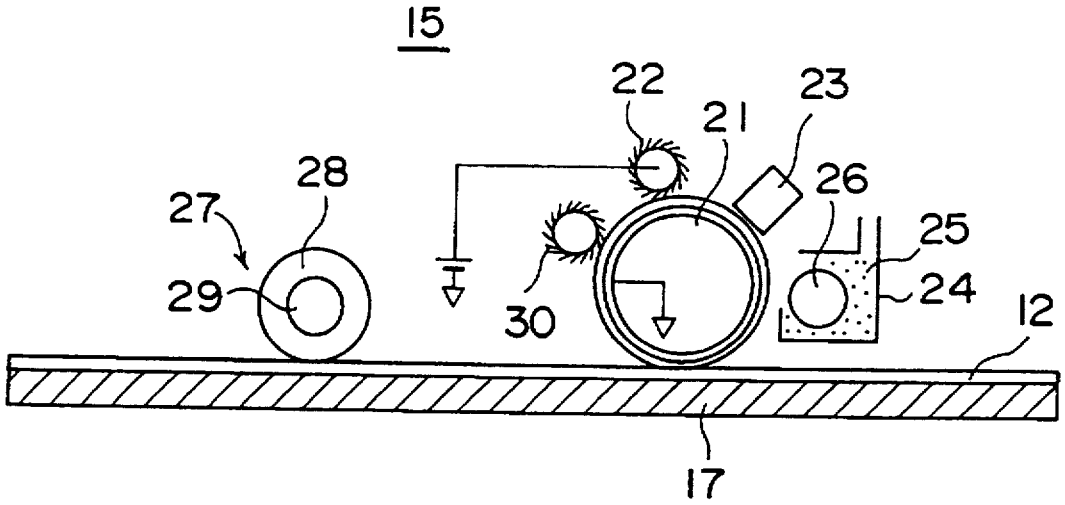
FIG. 2 PRIOR ART
FIG. 2 is a cross sectional view showing a carriage provided with a fixing unit.
Figure 3:
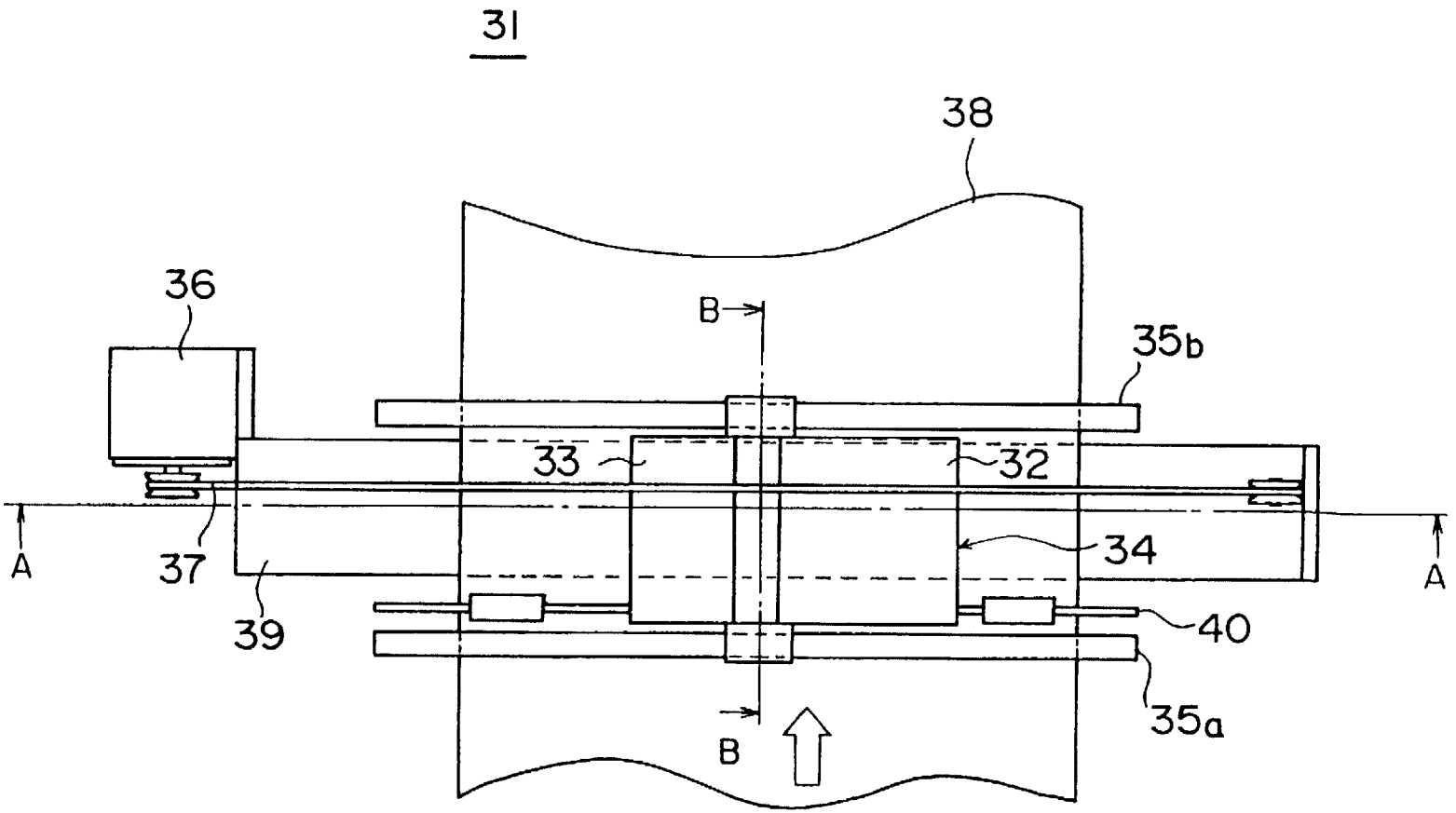
FIG. 3 PRIOR ART
FIG. 3 is a plan view showing a part of a second conventional serial printer.
Figure 4A:
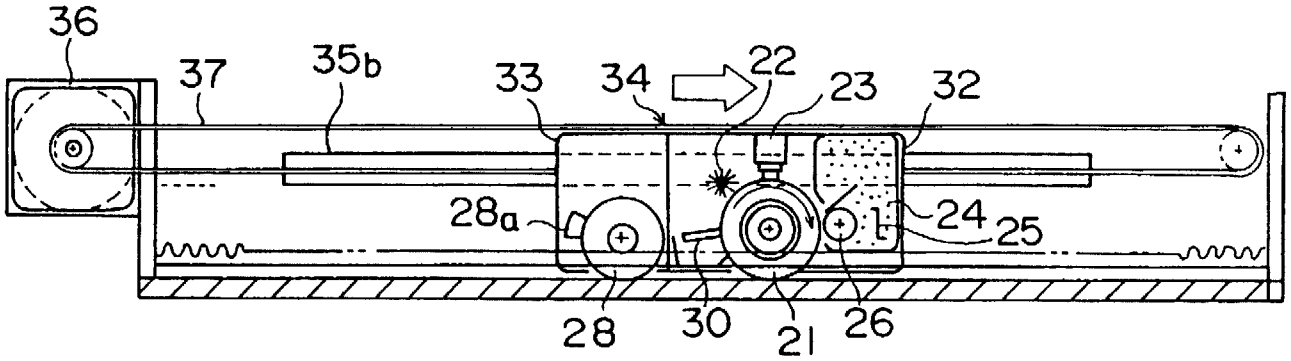
FIG. 4A PRIOR ART
FIGS. 4A and 4B respectively are cross sectional views along lines 4A—4A and 4B—4Bin FIG. 3.
Figure 4B:
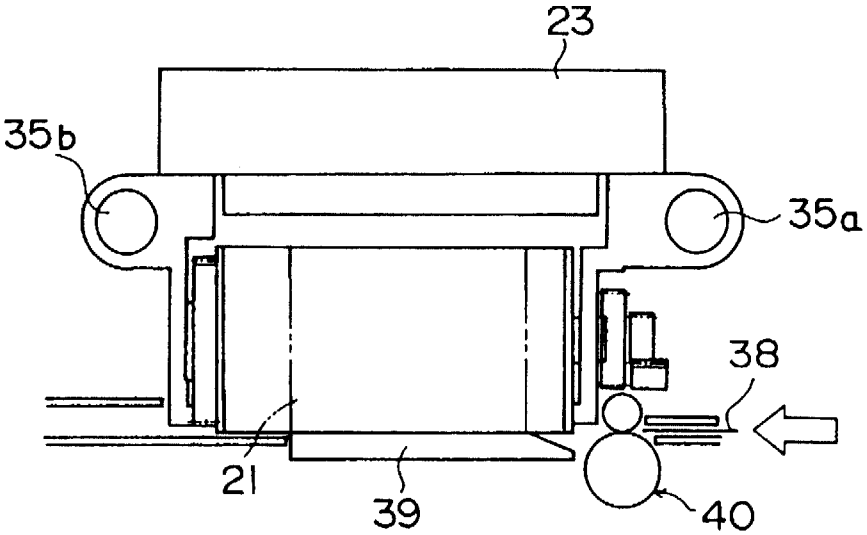
FIG. 4B PRIOR ART
Figure 5A:
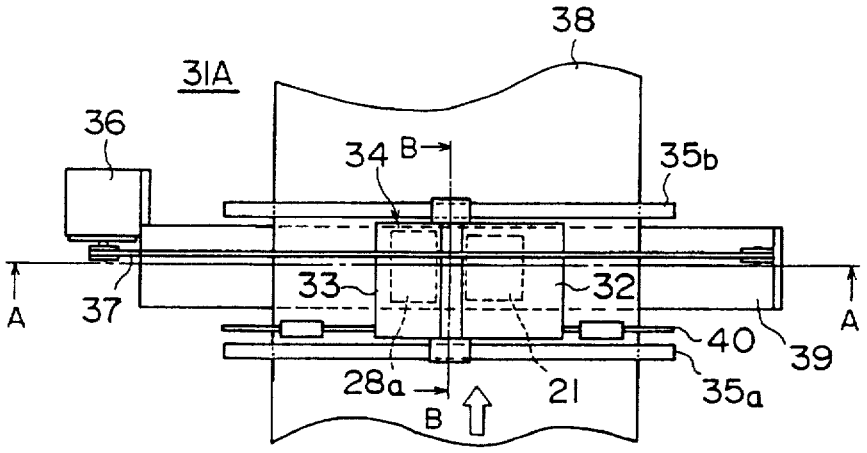
FIG. 5A PRIOR ART
FIG. 5A is a plan view showing a part of a third conventional serial printer.
Figure 5B:
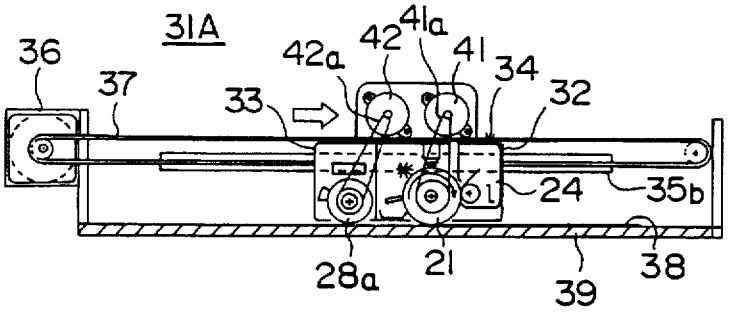
FIG. 5B PRIOR ART
FIGS. 5B and 5C respectively are cross sectional views along lines 5B—5B and 5C—5C, respectively, in FIG. 5A.
Figure 5C:
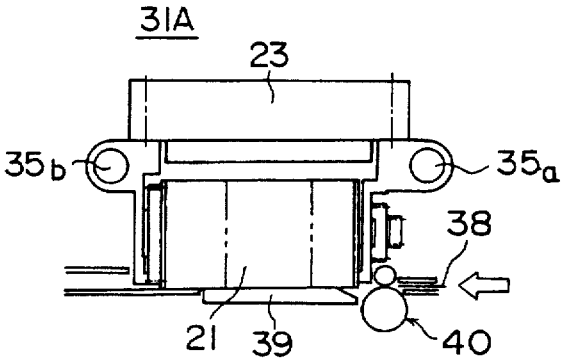
FIG. 5C PRIOR ART
Figure 6A:
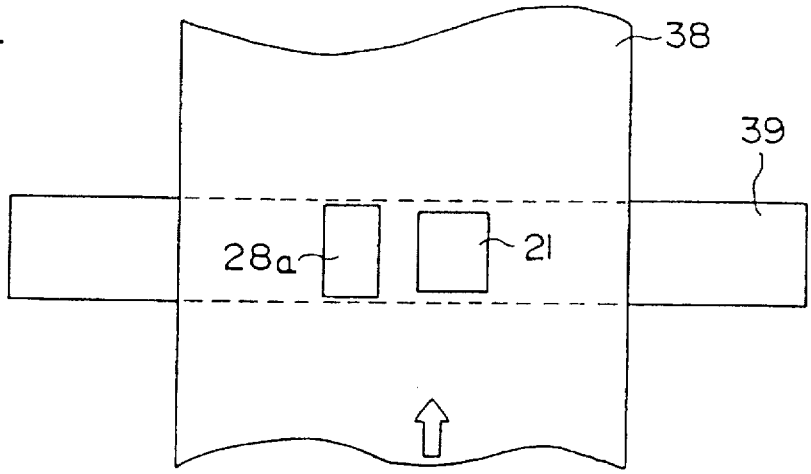
FIG. 6A PRIOR ART
FIGS. 6A and 6B respectively are diagrams for explaining the print operation of the third conventional serial printer.
Figure 6B:
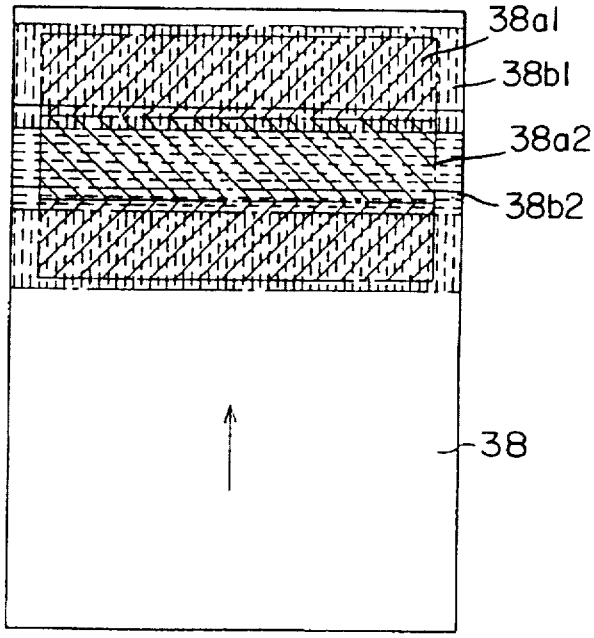
FIG. 6B PRIOR ART

Therefore, in this embodiment, the fixed regions formed by the fixing roller 91 will not overlap within the same printed region as in the conventional case shown in FIG. 6B. As a result, the characteristics of the recording sheet 59 such as the moisture absorbency of the recording sheet 59 become constant, thereby making it possible to improve the printing quality.

Figure 13A:
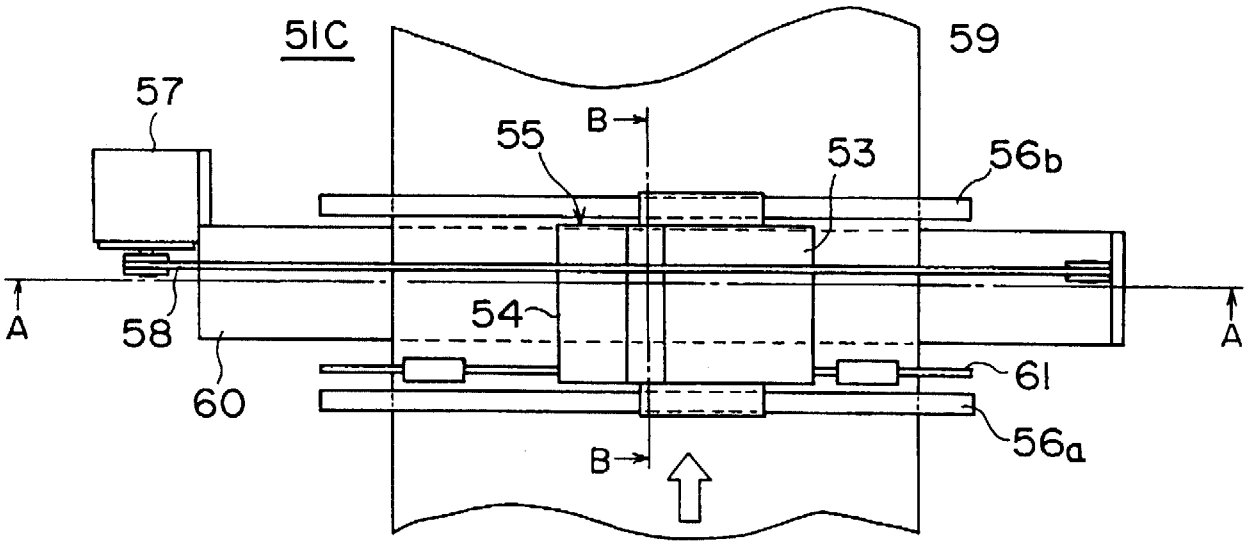
FIG. 13A is a plan view showing a part of a third embodiment of the serial printer according to the present invention.
Figure 13B:
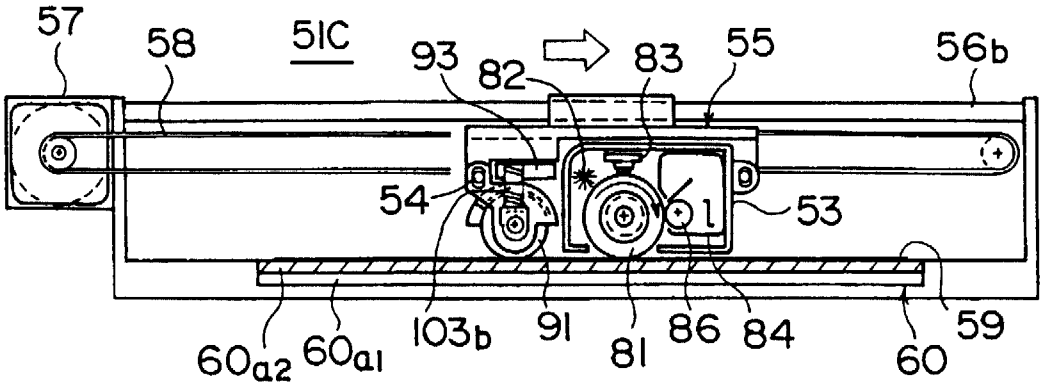
FIG. 13B is a cross sectional view along a line 13B—13B in FIG. 13A.
Figure 14:
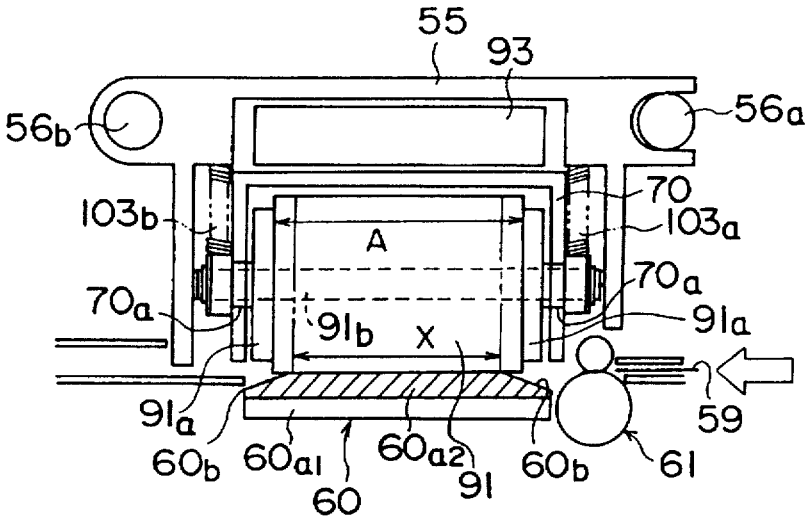
FIG. 14 is a cross sectional view along a line 14B—14B in FIG. 13A.

Next, a description will be given of a third embodiment of the serial printer according to the present invention. FIG. 13A shows a plan view of the third embodiment, and FIG. 13B shows a cross section along a line 13B—13B in FIG. 13A. FIG. 14 shows a cross section along a line 14—14 in FIG. 13A. In FIGS. 13A, 13B and 14, those parts which are the same as those corresponding parts in FIGS. 7 through 12B are designated by the same reference numerals, and a description thereof will be omitted.

In a serial printer $51_C$ shown in FIGS. 13A and 13B, the carriage 55 which is provided with the processing part 53 and the fixing unit 54 is moved in a direction perpendicular to the sheet transport direction by the carrier motor 57 via the belt 58, under the guidance of the guide shafts **56*a* and 56*b*, similarly to the serial printer $51_B$ shown in FIGS. 11A and 11B. In addition, the transfer unit 60 is arranged under the carriage 55** and extends in the carriage moving direction.

As shown in FIG. 14, the transfer unit 60 includes a substrate $60_{a1}$ made of aluminum or the like, and a heat-resistant conductive member $60_{a2}$ formed on the substrate $60_{a1}$. The heat-resistant conductive member $60_{a2}$ is made of silicon rubber or the like, as will be described later in conjunction with the sixth embodiment. A tapered part **60*b* is formed on both sides of the heat-resistant conductive member $60_{a2}$ along the sheet transport direction, in order to enable transport of the recording sheet 59 in a reverse direction for making a carriage return in the reverse direction to a preceding line. Of course, the tapered part 60*b*** may be formed on only one side of the heat-resistant conductive member $60_{a2}$ along the sheet transport direction.

In this case, a width X of the contact surface between the transfer unit 60 and the fixing roller 91 and defined by the tapered parts **60*b* is set smaller than a width A of the fixing roller 91. As a result, it is possible to prevent damage to the recording sheet 59 by the end edges of the fixing roller 91**.

The transport roller 61 transports the recording sheet 59 between the carriage 55 and the transfer unit 60.

In the processing part 53, the charger 82, the exposing unit 83 and the developing unit 84 are arranged around the recording drum 81 as described above. The illustration of the cleaner 89 is omitted in FIG. 13B.

On the other hand, as shown in FIG. 14, the fixing unit 54 is provided with the fixing roller 91 and the halogen lamp 93. The fixing roller 91 is held by a shaft **91*b*, and this shaft 91*b* penetrates elongated holes 70*a* formed in the fixing unit housing 70. A flange 91*a* having a stepped structure (2-step structure) and a diameter smaller than that of the fixing roller 91 is press-fit on both ends of the shaft 91*b*. For example, the flange 91*a* is made of a heat-resistant resin such as polyphenyline sulfide (PPS). Pressure applying springs 103*a* and 103*b* are provided at the ends of the flanges 91*a* for pushing the fixing roller 91 towards the transfer unit 60. In other words, the fixing roller 91 rotates as the carriage 55 moves due to the friction introduced between the fixing roller 91 and the recording sheet 59 when the fixing roller 91 is pushed against the recording sheet 59 by the action of the springs 103*a* and 103*b***.

Therefore, the fixing roller 91 is pushed against the transfer unit 60 (recording sheet 59) with a constant pressure of 1 kg, for example, by the action of the springs **103*a* and 103*b*. In addition, the damage to the recording sheet 59 is prevented at both ends of the fixing roller 91 by the provision of the tapered parts 60*a* of the transfer unit 60**. As a result, it is possible to carry out a stable fixing, thereby improving the printing quality.

The fixing roller 91 may be heated by means other than the halogen lamp 93. For example, a heat inducing method, a method that heats only when the carriage 55 is at the home position and the like may be employed when heating the fixing roller 91.

Figure 15:
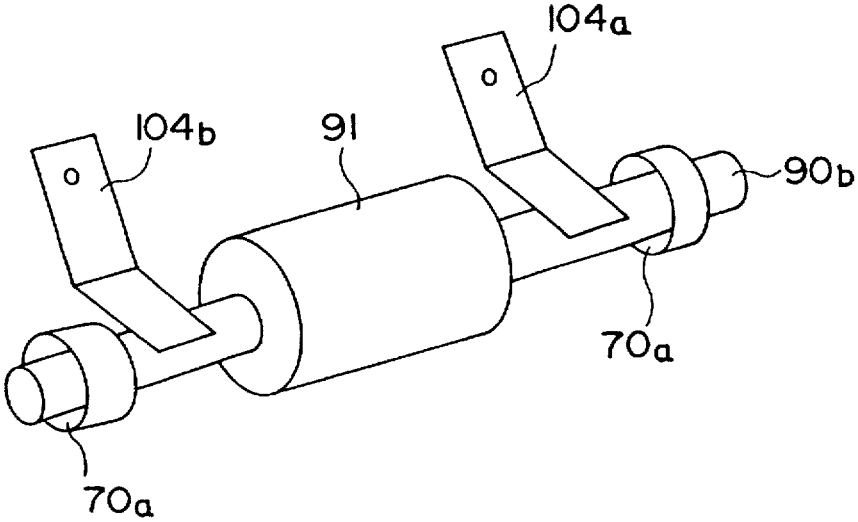
FIG. 15 is a perspective view showing a part of a modification of the third embodiment.

Next, a description will be given of a modification of the third embodiment, by referring to FIG. 15. FIG. 15 shows a perspective view of the fixing roller 91 and related parts of this modification.

In FIG. 15, the shaft **91*b* which holds the fixing roller 91 penetrates (i.e. extends through) the elongated holes 70*a* in the fixing unit housing 70. Leaf springs 104*a* and 104*b* push the shaft 91*b* on both sides of the fixing roller 91**.

In other words, in this modification, the fixing roller 91 is pushed against the transfer unit 60 (recording sheet 59) by the springs **103*a* and 103*b* shown in FIG. 14 and the leaf springs 104*a* and 104*b* shown in FIG. 15, and the fixing roller 91 rotates in synchronism with the recording drum 81** in this state. As a result, it is possible to prevent the image quality from becoming poor due to a rotational error or deviation, thereby improving the printing quality.

Figure 16:
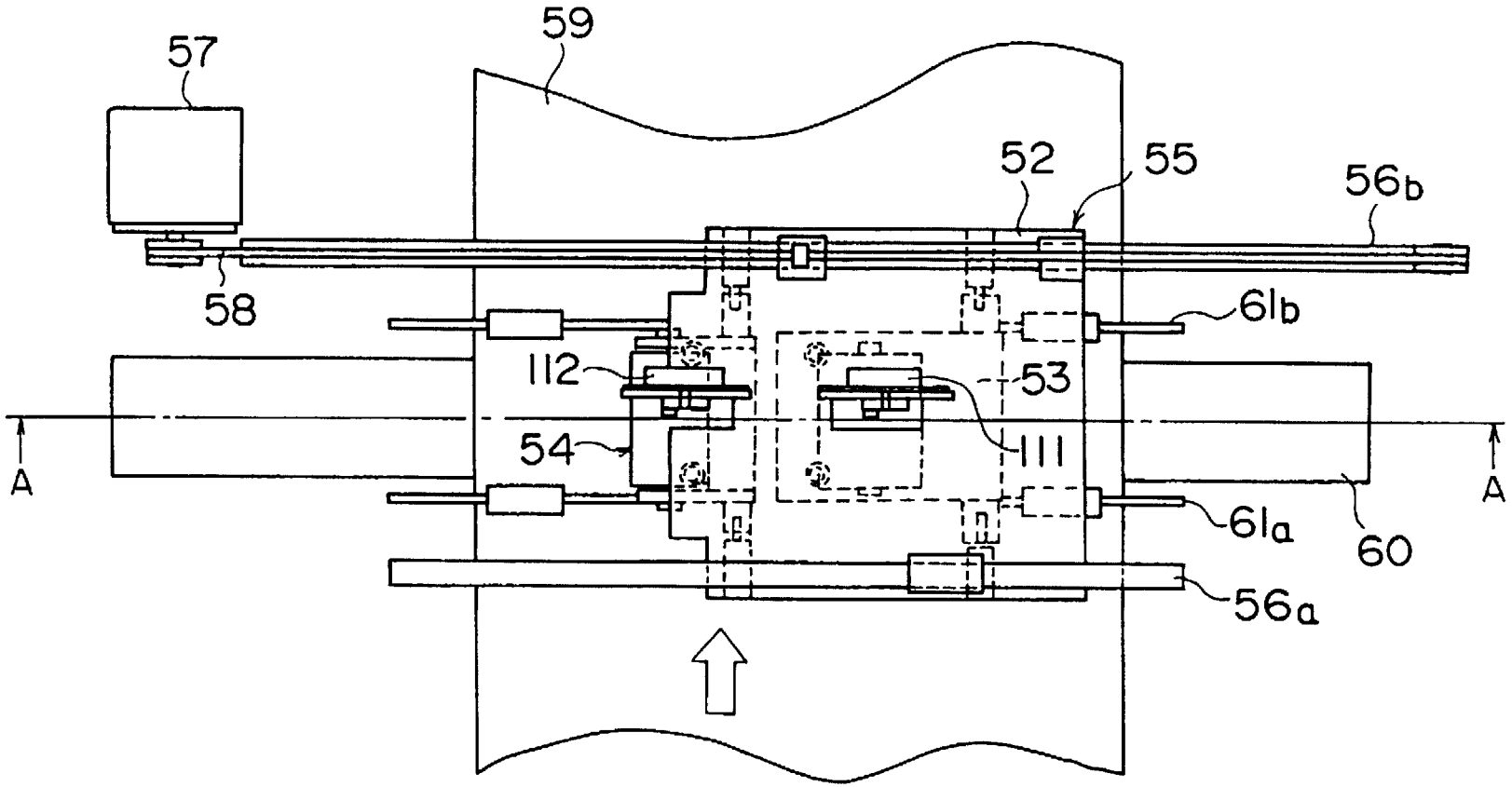
FIG. 16 is a plan view showing a part of a fourth embodiment of the serial printer according to the present invention.

Next, a description will be given of a fourth embodiment of the serial printer according to the present invention, by referring to FIG. 16. In FIG. 16, those parts which are the same as those corresponding parts in FIG. 7 are designated by the same reference numerals, and a description thereof will be omitted.

In a serial printer $51_D$ shown in FIG. 16, transport rollers **61*a* and 61*b* are arranged on both sides of the transfer unit 60. In addition, a carriage $55_A$ is guided by the guide shafts 56*a* and 56*b* and is moved by the carrier motor 57 via the belt 58. The processing part 53 and the fixing unit 54 are pivotably provided on the slide member 52 of the carriage $55_A$. The processing part 53 and the fixing unit 54 are pivotable independently of each other. In this case, the fixing unit 54 is arranged on the home position side along the carriage moving direction relative to the processing part 53**.

Figure 17A:
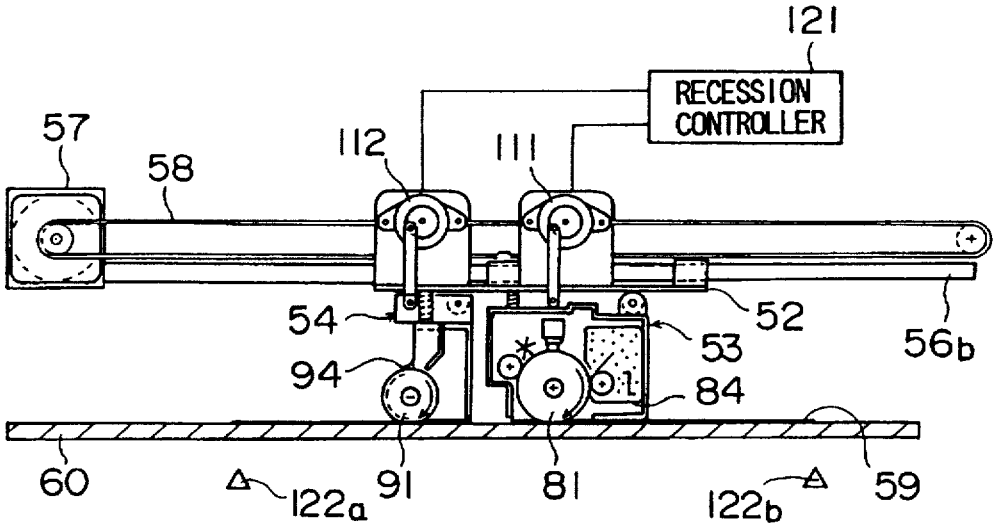
FIG. 17A is a cross sectional view along a line 17A—17A in FIG. 16.
Figure 17B:
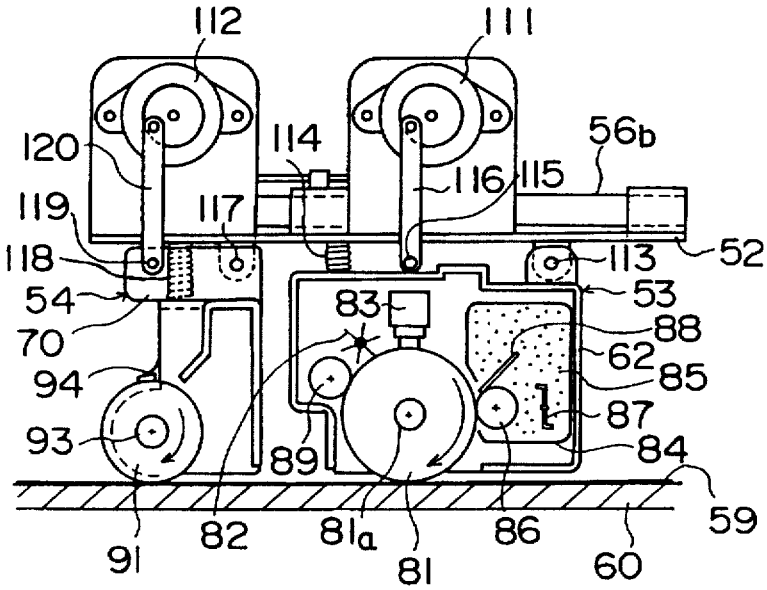
FIG. 17B is a cross sectional view as in FIG. 17A showing a carriage of the fourth embodiment on an enlarged scale.

FIG. 17A shows a cross section along a line 17A—17A in FIG. 16, and FIG. 17B shows an enlarged cross section of the carriage $55_A$ of FIG. 17A.

In the carriage $55_A$ shown in FIGS. 17A and 17B, a first recession motor 111 and a second recession motor 112 are provided on the slide member 52 which engages the shafts **56*a* and 56*b*. The first recession motor 111 causes the processing part 53 to recede, and the second recession motor 112 causes the fixing unit 54 to recede. One end on the top of the processing part housing 62 is linked to the lower surface of the slide member 52 via a pin 113, while the other end on the top surface of the processing part housing 62 is linked to the lower surface of the slide member 52 via a spring 114. The one end on the top of the process part housing 62** is located on the downstream side along the carriage moving direction relative to the home position.

One end of an arm 116 is linked to a middle part on the top of the processing part housing 62 via a pin 115, and the other end of the arm 116 is linked to an eccentric position of the rotary shaft of the first recession motor 111. In other words, the arm 116 moves up and down when the first recession motor 111 rotates, and the processing part housing 62 pivots about the pin 113 to separate from the recording sheet 59.

As described above in conjunction with FIG. 8B, the charger 82, the exposing unit 83, the developing unit 84 and the cleaner 89 are arranged around the recording drum 81 within the process part housing 62, so as to form the process part 55.

One end on the top of the fixing unit housing 70 is linked to the lower surface of the slide member 52 via a pin 117, while the other end on the top surface of the fixing unit housing 70 is linked to the lower surface of the slide member 52 via a spring 118. The one end on the top of the fixing unit housing 70 is located on the downstream side along the carriage moving direction relative to the home position.

One end of an arm 120 is linked to a middle part on the top of the fixing unit housing 70 via a pin 119, and the other end of the arm 120 is linked to an eccentric position of the rotary shaft of the second recession motor 112. In other words, the arm 120 moves up and down when the second recession motor 112 rotates, and the fixing unit housing 70 pivots about the pin 117 to separate from the recording sheet 59.

The fixing roller 91 having the halogen lamp 93 provided therein as the heat source, and the thermistor 94 are provided within the fixing unit housing 70.

The first and second recession motors 111 and 112 are controlled by a recession controller 121.

Width detecting sensors 122*a* and 122*b* are provided in a vicinity of the transfer unit 60 to detect the width of the recording sheet 59.

Figure 18:
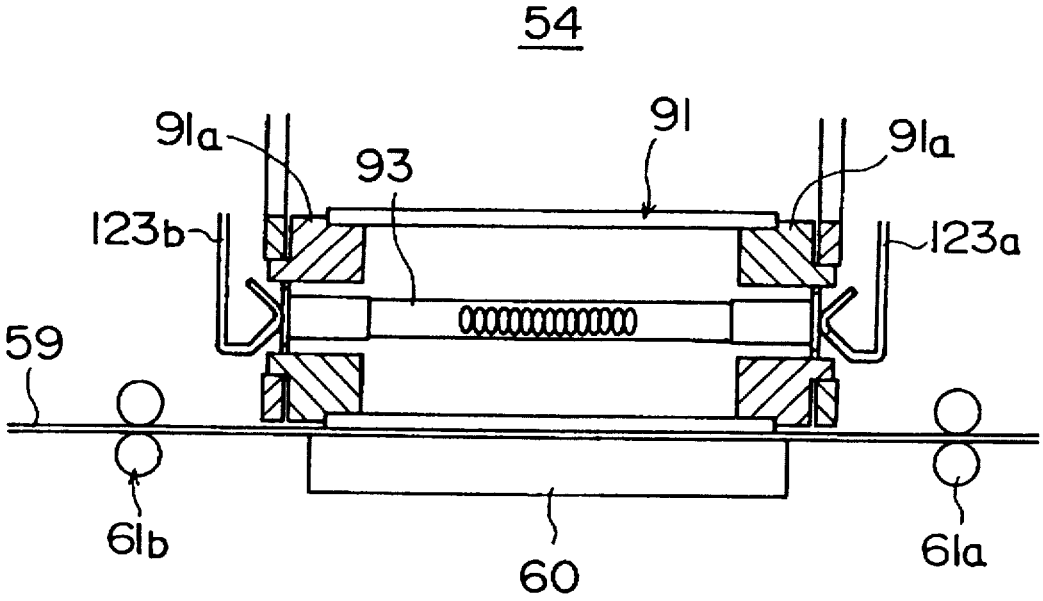
FIG. 18 is a cross sectional view showing a fixing unit of the fourth embodiment.

FIG. 18 shows a cross section of the fixing unit 54 shown in FIG. 16. In FIG. 18, the halogen lamp 93 which acts as the heat source is provided between the central portions of the flanges 91*a* on both ends of the fixing roller 91. Terminals 123*a* and 123*b* for supplying power to the halogen lamp 93 are provided on respective ends of the halogen lamp 93 in a state where the terminals 123*a* and 123*b* push against the ends of the halogen lamp 93.

Next, a description will be given of the operation of this fourth embodiment, by referring to FIGS. 19A through 19C and FIGS. 20A and 20B.

Figures 19A, 19B, 19C:
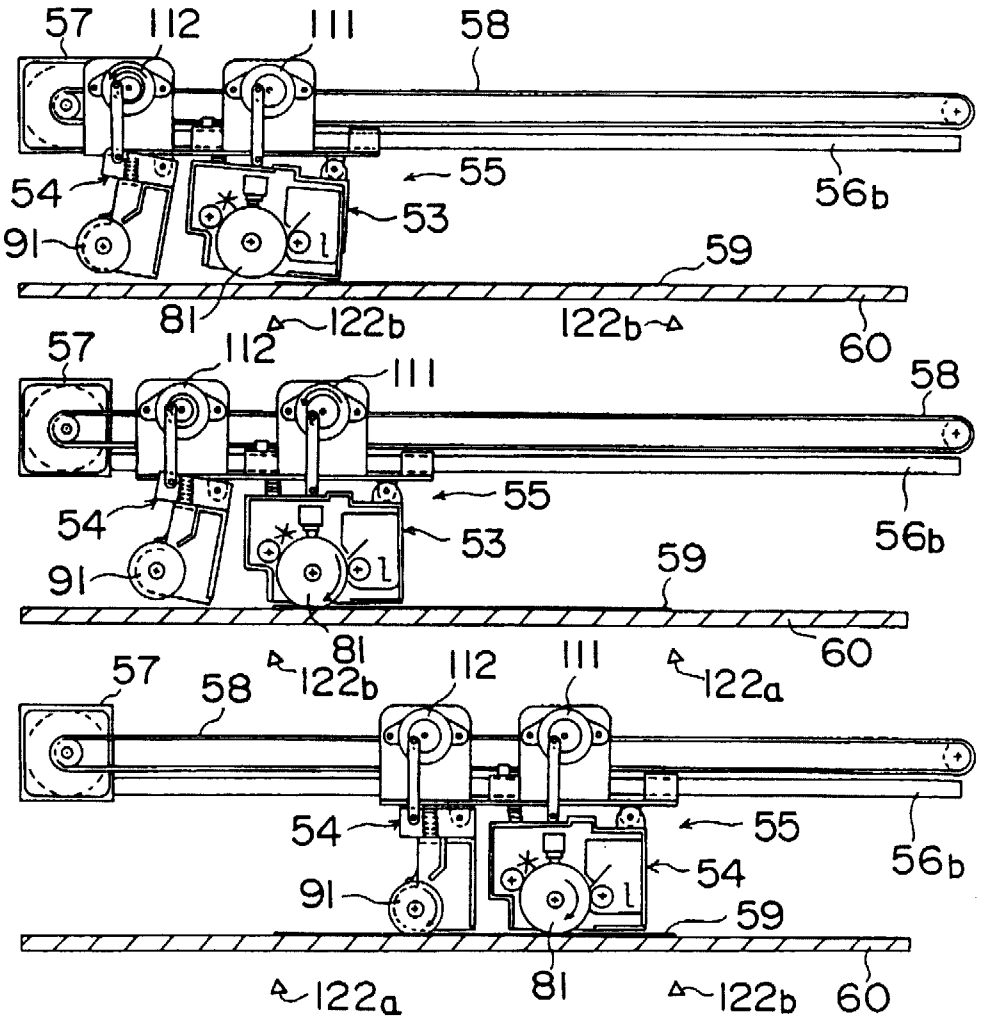
FIGS. 19A, 19B and 19C respectively are cross sectional views, each as in FIG. 17A, for explaining the operation of the fourth embodiment.

In FIG. 19A, the carriage $55_A$ is in a standby state at the home position. In this state, the process part 53 and the fixing unit 54 of the carriage $55_A$ are already pivoted and separated from the recording sheet 59 (transfer unit 60) by the rotation of the first and second recession motors 111 and 112.

Then, when the width detecting sensors 122*a* and 122*b* detect that the recording sheet 59 is transported, the print start position on the recording sheet 59 is determined, and the carrier motor 57 is driven to move the carriage $55_A$ to a position where the recording drum 81 of the processing part 53 is located above the print start position as shown in FIG. 19B. At this position of the carriage $55_A$, the first recession motor 111 is rotated to return the processing part 53 from the receded position to the position in contact with the recording sheet 59, so that the recording drum 81 makes contact with the recording sheet 59 at the print start position.

Next, the carrier motor 57 is driven to move the carriage $55_A$ and to carry out the printing on the recording sheet 59 by the processing part 53. In this state, when the fixing roller 91 of the fixing unit 54 reaches the print start position on the recording sheet 59, the second recession motor 112 is rotated to return the fixing unit 54 from the receded position to the position in contact with the recording sheet 59 as shown in FIG. 19C, so that the fixing roller 91 makes contact with the recording sheet 59 at the print start position.

Figure 20A:
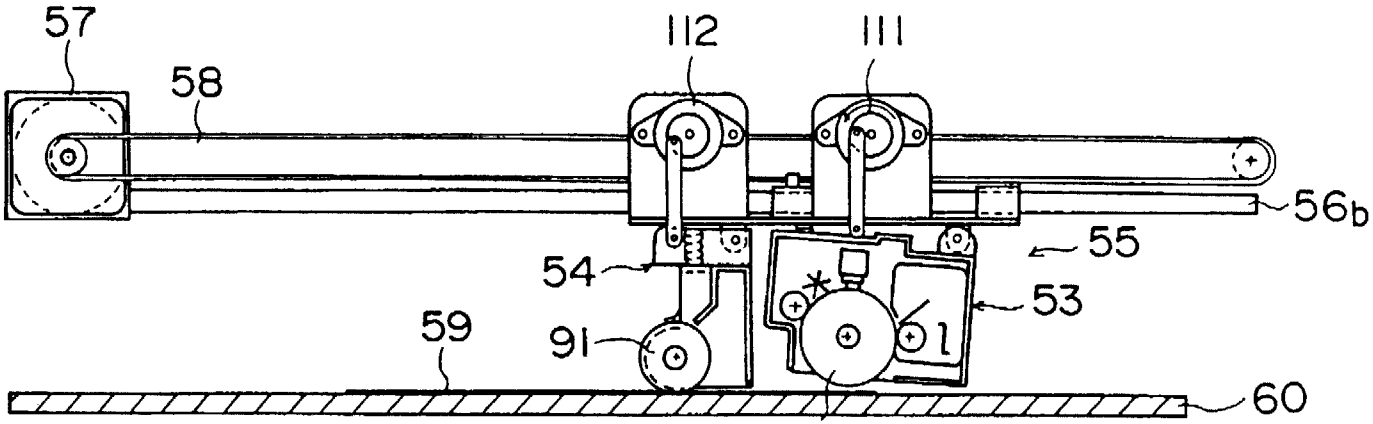
FIGS. 20A and 20B respectively are cross sectional views, as in FIG. 17A, for explaining the operation of the fourth embodiment.

Then, when the recording drum 81 reaches a print end position on the recording sheet 59, the first recession motor 111 is rotated to pivot the process part 53 to the receded position as shown in FIG. 20A, so that the recording drum 81 separates from the recording sheet 59.

Figure 20B:
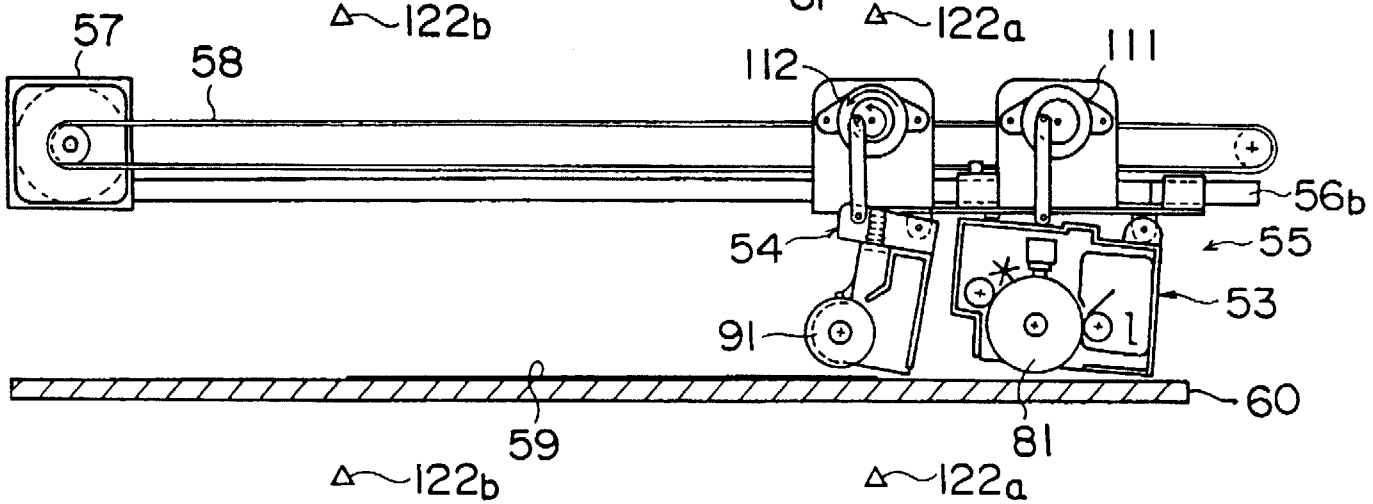

In addition, when the fixing roller carries out the fixing to the print end position on the recording sheet 59, the second recession motor 112 is rotated to pivot the fixing unit 54 to the receded position as shown in FIG. 20B, so that the fixing roller 91 separates from the recording sheet 59.

In the state shown in FIG. 20B where both the process part 53 and the fixing unit 54 in the receded positions, the carrier motor 57 is driven to return the carriage $55_A$ to the home position shown in FIG. 19A.

Therefore, the recording drum 81 and the fixing roller 91 will not make contact with parts other than the recording sheet 59. For this reason, it is possible to prevent damage to parts caused by the toner or foreign particles, and a satisfactory image quality can be obtained. Further, since the fixing roller 91 will not make contact with the transfer unit 60, it is possible to prevent the toner from adhering on the transfer unit 60 to extend the service life of the transfer unit 60. It is also possible to prevent thermal destruction or thermal deterioration of the transfer unit 60 which would otherwise occur if there is contact between the fixing roller 91 and the transfer unit 60.

Figure 21A:
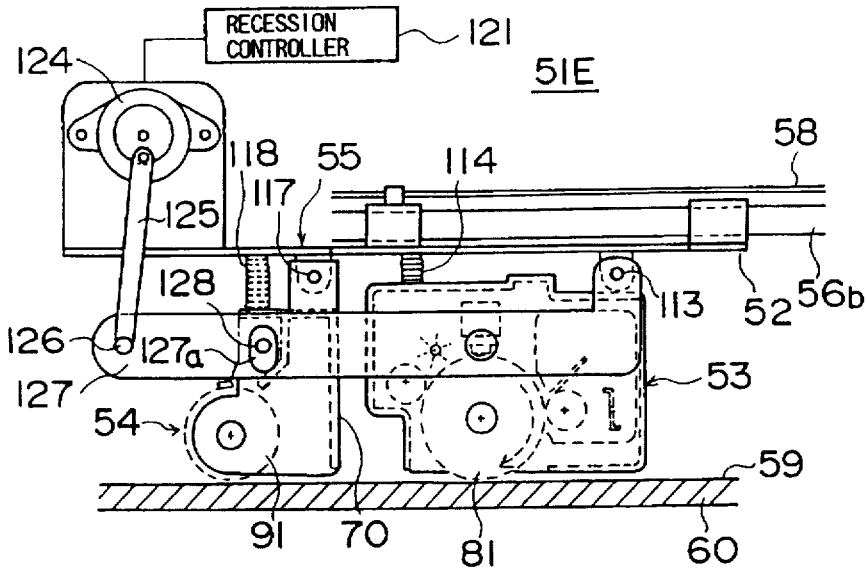
FIGS. 21A, 21B and 21C respectively are cross sectional views for explaining a fifth embodiment of the serial printer according to the present invention.
Figure 21B:
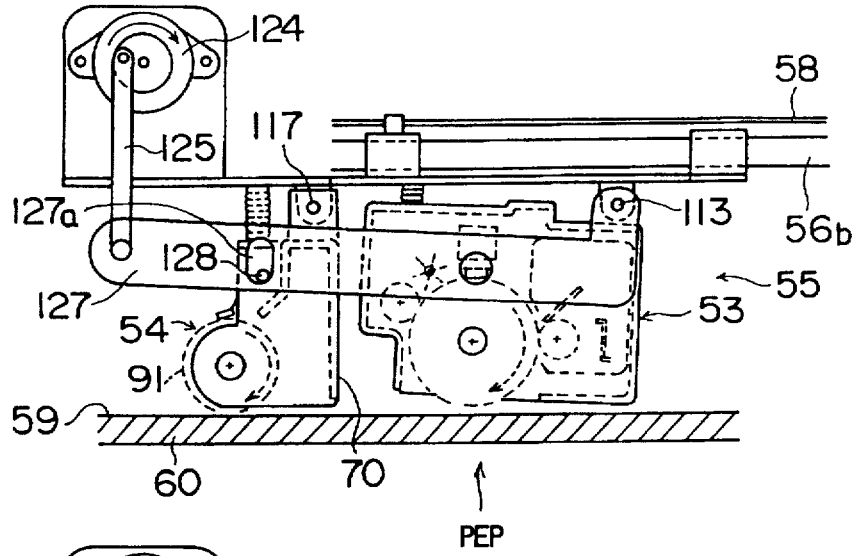
Figure 21C:
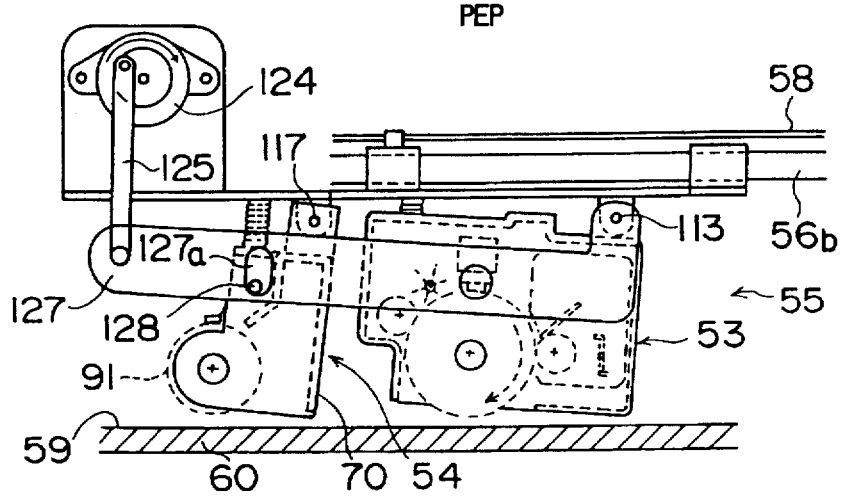

Next, a description will be given of a fifth embodiment of the serial printer according to the present invention, by referring to FIGS. 21A through 21C. FIGS. 21A through 21C show cross sections of the carriage part of a serial printer $51_E$. In FIGS. 21A through 21C, those parts which are the same as those corresponding parts in FIGS. 16 through 20B are designated by the same reference numerals, and a description thereof will be omitted.

In FIG. 21A, the process part 53 is linked to the slide member 52 via the pin 113 and the spring 114, and the fixing unit 54 is linked to the slide member 52 via the pin 117 and the spring 118, similarly to the fourth embodiment described above.

A recession motor 124 which is controlled by the recession controller 121 is provided on the slide member 52. One end of an arm 125 is linked to an eccentric position of the rotary shaft of the recession motor 124, and the other end of the arm 125 is linked to one end of a movable plate 127 via a pin 126. The other end of the movable plate 127 engages the pin 113 of the process part 53. In addition, an elongated hole 127*a* is formed in the movable plate 127 at a predetermined position corresponding to the fixing unit housing 70. An engaging pin 128 of the fixing unit housing 70 is movably received within the elongated hole 127*a*.

When the recession motor 124 is rotated at the print end position PEP as shown in FIG. 21B, the processing part 53 pivots about the pin 113 to the receded position. In this state, the engaging pin 128 of the fixing unit housing 70 will not be lifted due to the elongated hole 127*a* in the movable plate 127, and the fixing roller 91 remains in contact with the recording sheet 59.

When the recession motor 124 is rotated further, as shown in FIG. 21C, the engaging pin 128 engages the bottom edge of the elongated hole 127*a* in the movable plate 127, and the fixing unit 54 is pivoted to the receded position. The carriage 55 is returned to the home position in this state where both the process part 53 and the fixing unit 54 are pivoted to the receded positions.

The effects of this fifth embodiment are thus similar to those obtained in the fourth embodiment. However, this fifth embodiment only requires a single recession motor 124 compared to the fourth embodiment which requires the first and second recession motors 111 and 112. For this reason, this fifth embodiment can reduce both the size and cost of the serial printer $51_E$.

Figure 22A:
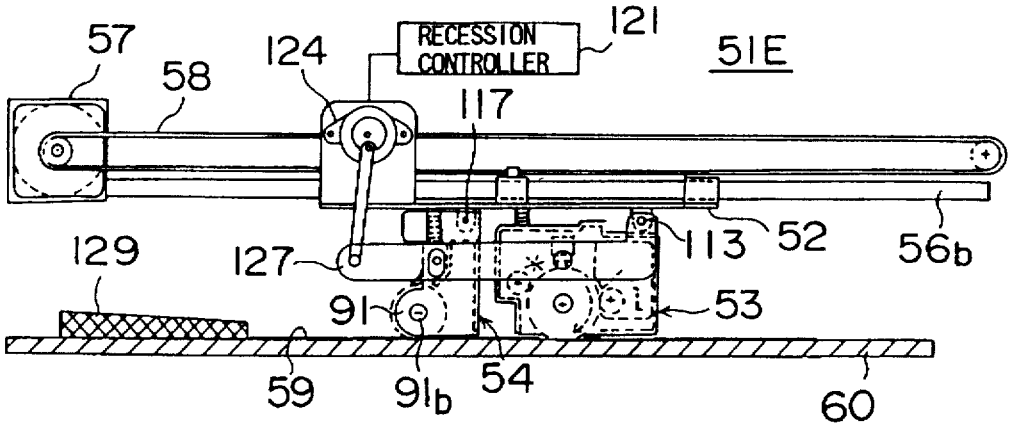
FIGS. 22A, 22B and 22C respectively are cross sectional views for explaining a modification of the fifth embodiment.
Figure 22B:
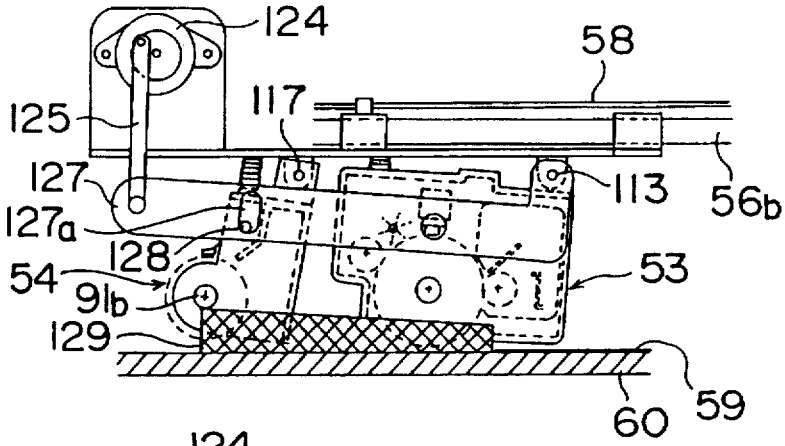
Figure 22C:
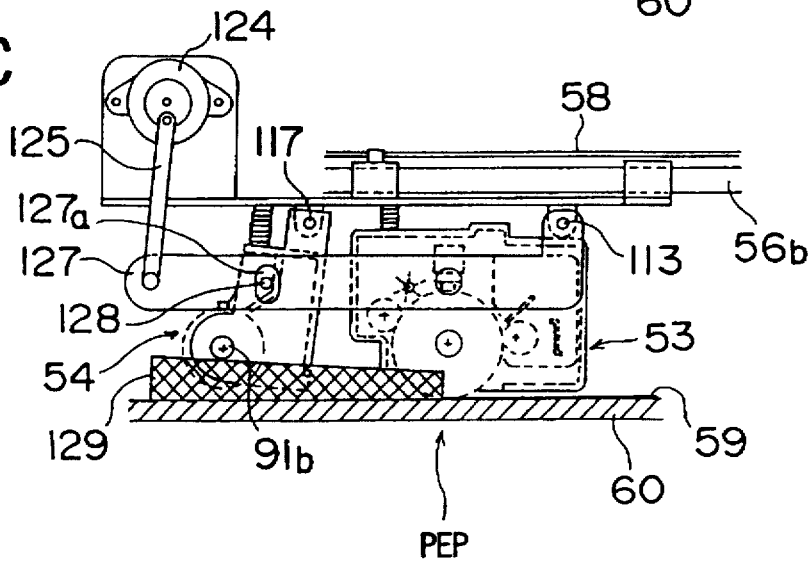

Next, a description will be given of a modification of the fifth embodiment, by referring to FIGS. 22A through 22C. FIGS. 22A through 22C show cross sections of the carriage part of the serial printer $51_E$. In FIGS. 22A through 22C, those parts which are the same as those corresponding parts in FIGS. 21A through 21C are designated by the same reference numerals, and a description thereof will be omitted.

In FIG. 22A, a recession base 129 is provided on the transfer unit 60 at the carriage home position which precedes the print start position along the carriage moving direction, as compared to the construction shown in FIG. 21A. The recession base 129 has a tapered shape so that the recession base 129 is higher towards the home position side. This recession base 129 makes contact with the end of the shaft 91*b* of the fixing roller 91. Of course, it is possible to provide the recession base 129 on both sides so that both ends of the shaft 91*b* are supported by the respective recession bases 129.

When the carriage 55 is moved to the home position in the state where the processing part 53 and the fixing unit 54 are in the receded positions, the shaft 91*b* of the fixing roller 91 rolls on the highest portion of the recession base 129, thereby further pivoting the fixing unit 54 about the pin 117 as shown in FIG. 22B.

On the other hand, when starting the fixing, the shaft 91*b* rolls on the tapered surface of the recession base 129 and the fixing unit 54 is gradually lowered as the carriage 55 moves in the carriage moving direction as shown in FIG. 22C. The fixing roller 91 of the fixing unit 54 starts to make contact with the recording sheet 59 at the print start position.

Although only a single recession motor 124 is used, it is possible to control the fixing unit 54 to further recede even when the carriage 55 is located at the home position.

Figure 23A:
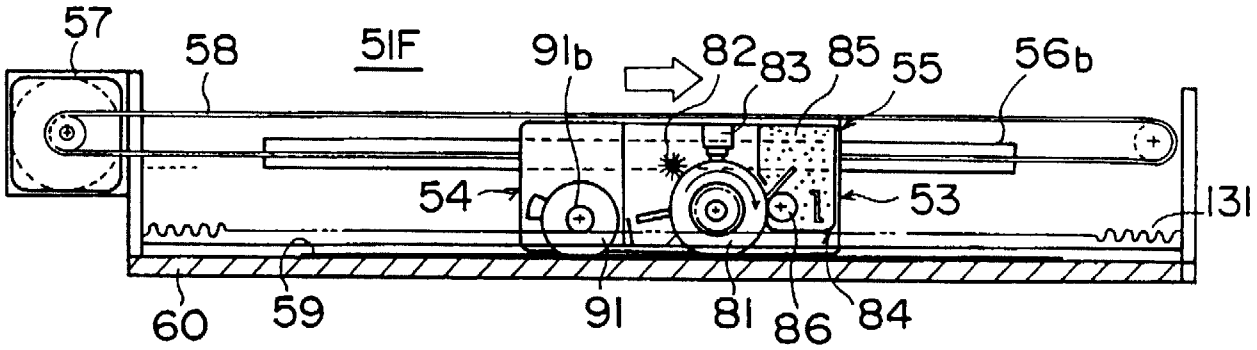
FIG. 23A is a cross sectional view showing a part of a sixth embodiment of the serial printer according to the present invention.
Figure 23B:
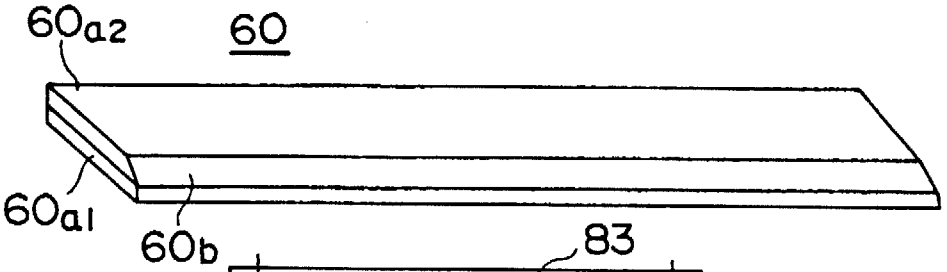
FIG. 23B is a perspective view showing a transfer unit of the sixth embodiment.
Figure 23C:
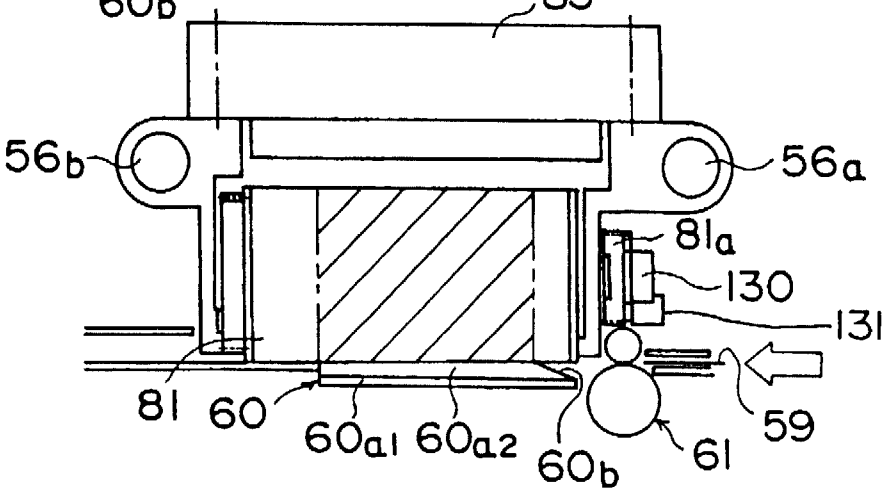
FIG. 23C is a cross sectional view showing a process part of the sixth embodiment.

Next, a description will be given of a sixth embodiment of the serial printer according to the present invention, by referring to FIGS. 23A through 23C. FIG. 23A shows a cross section of the sixth embodiment, FIG. 23B shows a perspective view of the transfer unit 60 shown in FIG. 23A, and FIG. 23C shows a cross section of the processing part 53 shown in FIG. 23A. In FIGS. 23A through 23C, those parts which are the same as those corresponding parts in FIGS. 7 through 22C are designated by the same reference numerals, and a description thereof will be omitted.

In a serial printer $51_F$ shown in FIG. 23A, the carriage 55 provided with the processing part 53 and the fixing unit 54 is guided by the guide shafts 56*a* and 56*b* and is moved in the direction P perpendicular to the sheet transport direction T by the carrier motor 57 via the belt 58, similarly to the embodiments described above.

As described above in respect of the other embodiments, the charger 82, the exposing unit 83, the developing unit 84 and the cleaner 89 are arranged around the recording drum 81 which has the rotary shaft 81*a*. As shown in FIG. 23C, a pinion gear 130 is provided on one end of the rotary shaft 81*a*.

The fixing unit 54 is provided with the fixing roller 91 having the shaft 91*b*, and a pinion gear (not shown) is provided on one end of the shaft 91*b*. The illustration of the heating means and the thermistor is omitted in FIGS. 23A and 23C.

A rack 131 is provided along the carriage moving direction as shown in FIG. 23A. The pinion gear 130 of the recording drum 81 and the pinion gear of the fixing roller 91 mesh and engage this rack 131. Hence, as the carriage 55 moves, the recording drum 81 and the fixing roller 91 rotate in synchronism with each other.

The transfer unit 60 is arranged along the carriage moving direction. As shown in FIG. 23B, the transfer unit 60 includes the substrate $60_{a1}$, and the heat-resistant conductive member $60_{a2}$ formed on the substrate $60_{a1}$. The substrate $60_{a1}$ is made of a conductive material such as aluminum. On the other hand, the heat-resistant conductive member $60_{a2}$ is made of silicon rubber or the like having conductive material mixed therein. The tapered part 60*b* is formed on one side (upstream side) of the heat-resistant conductive member $60_{a2}$ along the sheet transport direction. Of course, the tapered part 60*b* may be formed on both sides (upstream and downstream sides) of the heat-resistant conductive member $60_{a2}$ along the sheet transport direction.

The transfer unit 60 transfers the toner image formed on the surface of the recording drum 81 onto the recording sheet 59. Hence, in order to make this transfer of the toner image, a transfer bias is applied to the substrate $60_{a1}$ so that a voltage having an opposite polarity as the charged toner 55 is applied on the entire surface of the transfer unit 60. The voltage applied on the entire surface of the transfer unit 60 is approximately 800 V, for example. The entire surface of the transfer unit 60 corresponds to the surface area of the recording drum 81 defined as (the effective printing width)× (width along the main scan direction). As a result, it is possible to uniformly charge the entire surface of the heat-resistant conductive member $60_{a2}$ which makes direct contact with the recording sheet 59.

Because the fixing roller 91 is heated to a temperature of approximately 180° C. or greater, it is possible to prevent thermal deterioration and thermal destruction of the transfer unit 60 by using the heat-resistant conductive member $60_{a2}$ that can withstand high temperatures on the order of 220° C. or greater. In addition, since it is necessary to push the fixing roller 91 against the recording sheet 59 at a constant pressure, the provision of the heat-resistant conductive member $60_{a2}$ which is resilient makes it possible to improve the fixing rate and accordingly improve the printing quality. In this case, the substrate $60_{a1}$ prevents unwanted warping of the transfer unit 60 even under the pressure of the fixing roller 91.

The transfer unit 60 shown in FIG. 23B can of course be applied to each of the embodiments described above.

Further, the present invention is not limited to these embodiments, but various variations and modifications may be made without departing from the scope of the present invention.

What is claimed is:

1. A serial printer comprising:

transport means for transporting a recording sheet in a sheet transport direction;

processing means, including an image bearing member having a rotary shaft which extends in a direction parallel to the sheet transport direction, for forming a latent image on the image bearing member by charging the image bearing member and developing the latent image into a developed image;

fixing means for fixing the developed image, on the image bearing member, onto the recording sheet; and a carriage movable in a carriage moving direction, perpendicular to the sheet transport direction, and supporting said processing means and said fixing means, said processing means and said fixing means being independently movable on said carriage.

2. The serial printer as claimed in claim 1, which further comprises:

a slide member provided on said carriage and supporting said processing means and said fixing means, said processing means and said fixing means being independently movable on said slide member; and guide means for guiding said slide member in the carriage moving direction and thereby guiding said carriage.

3. The serial printer as claimed in claim 2, which further comprises:

linking means for pivotably linking said processing means and said fixing means with respect to said slide member so that each of said processing means and said fixing means is independently pivotable between a normal position and a receded position, said processing means and said fixing means making contact with the recording sheet only in, the respective, normal positions thereof.

4. The serial printer as claimed in claim 3, which further comprises:

urging means for urging at least one of said processing means and said fixing means towards the recording sheet in the respective, normal positions thereof.

5. The serial printer as claimed in claim 3, wherein said linking means further comprises:

a first engaging part provided on said slide member; and a second engaging part provided on said processing means, said first and second engaging parts engaging each other so that said processing means is pivotable about an axis parallel to the sheet transport direction.

6. The serial printer as claimed in claim 3, which further comprises:

means for urging said processing means in a direction parallel to the sheet transport direction.

7. The serial printer as claimed in claim 2, which further comprises:

means for rotatably and detachably supporting the image bearing member of said processing means on said slide member.

8. The serial printer as claimed in claim 2, which further comprises:

a radiation member, provided on said processing means, isolating said processing means and said fixing means.

9. The serial printer as claimed in claim 2, which further comprises:

a processing housing accommodating the image bearing member of said processing means and isolating said processing means and said fixing means.

10. The serial printer as claimed in claim 3, which further comprises:

recession means for independently pivoting said processing means and said fixing means to the respective, receded positions thereof by separating said processing means and said fixing means from the recording sheet.

11. The serial printer as claimed in claim 10, wherein said recession means comprises:

a first driving part which moves said processing means to the receded position; and second driving part which moves said fixing means to the receded position.

12. The serial printer as claimed in claim 10, wherein said recession means comprises:

a single driving part which independently moves said processing means and said fixing means to the respective, receded positions thereof at mutually different timings.

13. The serial printer as claimed in claim 12, which further comprises:

a transfer member which transfers the developed image from the image bearing member to the recording sheet that is interposed between the image bearing member and the transfer member; and a recession part provided on the transfer member and moving said fixing means to the receded position thereof at a home position of said carriage where said carriage is located prior to a print operation.

14. The serial printer as claimed in claim 10, which further comprises:

a transfer member which transfers the developed image from the image bearing member to the recording sheet that is interposed between the image bearing member and the transfer member; and a plurality of sensors arranged adjacent said transfer member at predetermined intervals, depending on a width of the recording sheet, for detecting a print start position and a print end position on the recording sheet.

15. The serial printer as claimed in claim 2, wherein said fixing means further comprises a fixing member which fixes the developed image on the image bearing member to the recording sheet, said image bearing member and said fixing member being arranged at positions on said carriage deviated in the sheet transport direction.

16. The serial printer as claimed in claim 2, wherein said fixing means further comprises a fixing roller which fixes the developed image on the image bearing member to the recording sheet and has flanges on both ends thereof, along the sheet transport direction, said flanges having a diameter smaller than a diameter of a remaining portion of said fixing roller.

17. The serial printer as claimed in claim 2, which further comprises:

a transfer member for transferring the developed image on the image bearing member to the recording sheet that is interposed between the image bearing member and the transfer member, said transfer member having a width smaller than a width of said fixing member, in the sheet transport direction.

18. The serial printer as claimed in claim 17, wherein said transfer member has a tapered part on at least one of two ends thereof, along the sheet transport direction.

19. The serial printer as claimed in claim 2, which further comprises:

a transfer member which transfers the developed image on the image bearing member to the recording sheet that is interposed between the image bearing member and the transfer member, said transfer member having a conductive plate; and a resilient heat-resistant conductive member provided on the conductive plate.

20. The serial printer as claimed in claim 19, wherein said resilient heat-resistant conductive member has a tapered part on at least one of two ends thereof, along the sheet transport direction.

21. A serial printer comprising:

transport means for transporting a recording sheet in a sheet transport direction;

processing means, including an image bearing member having a rotary shaft which extends in a direction parallel to the sheet transport direction, for forming a latent image on the image bearing member by charging the image bearing member and developing the latent image into a developed image;

fixing means, including a fixing roller, for fixing the developed image, on the image bearing member, onto the recording sheet by the fixing roller; and a carriage movable in a carriage moving direction perpendicular to the sheet transport direction and supporting said processing means and said fixing means, said fixing roller having flanges on both ends thereof, along the sheet transport direction, said flanges having a diameter smaller than a diameter of a remaining portion of said fixing roller.

22. A serial printer comprising:

transport means for transporting a recording sheet in a sheet transport direction;

processing means, including an image bearing member having a rotary shaft which extends in a direction parallel to the sheet transport direction, for forming a latent image on the image bearing member by charging the image bearing member and developing the latent image into a developed image;

fixing means, including a fixing member, for fixing the developed image, on the image bearing member, onto the recording sheet by the fixing member;

a carriage movable in a carriage moving direction, perpendicular to the sheet transport direction, and supporting said processing means and said fixing means, said fixing means; and a transfer member for transferring the developed image on the image bearing member to the recording sheet that is interposed between the image bearing member and the transfer member, said transfer member having a width smaller than a width of said fixing member, in the sheet transport direction.

23. The serial printer as claimed in claim 23, wherein said transfer member has a tapered part on at least one of two ends thereof, in the sheet transport direction.

24. A serial printer comprising:

transport means for transporting a recording sheet in a sheet transport direction;

processing means, including an image bearing member having a rotary shaft which extends in a direction parallel to the sheet transport direction, for forming a latent image on the image bearing member by charging the image bearing member and developing the latent image into a developed image;

fixing means for fixing the developed image, on the image bearing member, onto the recording sheet;

a carriage movable in a carriage moving direction, perpendicular to the sheet transport direction, and supporting said processing means and said fixing means, said processing means and said fixing means being independently movable on said carriage; and a transfer member for transferring the developed image on the image bearing member to the recording sheet that is interposed between the image bearing member and the transfer member, said transfer member having a conductive plate and a resilient heat-resistant conductive member provided on the conductive plate and having a tapered part on at least one of two ends thereof along the sheet transport direction.

* * * * *

UNITED STATES PATENT AND TRADEMARK OFFICE

CERTIFICATE OF CORRECTION

PATENT NO. : 5,594,530

DATED : January 14, 1997

INVENTOR(S) : MASUDA et al.

It is certified that error appears in the above-indentified patent and that said Letters Patent is hereby corrected as shown below:

TITLE PAGE: [56] References Cited, under "FOREIGN PATENT DOCUMENTS", first reference, change "5/1981" to --6/1981--.

Col. 1, line 60, change "61-145849" to --61-145649--.
Col. 2, line 20, after "direction" insert --,--.
Col. 3, line 11, change "FIG." to --FIGS.--;
line 16, after "38 in" insert --a--;
line 28, after "$38_{a2}$" insert --,--.
Col. 10, line 47, change "line" to --lines--;
line 49, after "$59_{a2}$" insert --,--;
line 50, change "the hatching" to --cross-hatching--;
line 52, delete "the".
Col. 11, line 17, after "direction" insert --P--;
line 18, after "direction" insert --T--.
Col. 19, line 26 (Claim 22, line 15), delete "said fixing means,".
Col. 20, line 3 (Claim 23, line 1), change "23" to --22--.

Signed and Sealed this

First Day of July, 1997

Bruce Lehman

*Attest:*

BRUCE LEHMAN

*Attesting Officer*

*Commissioner of Patents and Trademarks*